US006931216B2

(12) United States Patent
Mochizuki et al.

(10) Patent No.: US 6,931,216 B2
(45) Date of Patent: Aug. 16, 2005

(54) IMAGE FORMING APPARATUS AND THE CONTROL METHOD INCLUDING A FEATURE OF DETECTING A REMAINING AMOUNT OF A DEVELOPER

(75) Inventors: Masataka Mochizuki, Shizuoka (JP); Atsuya Takahashi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/459,428

(22) Filed: Jun. 12, 2003

(65) Prior Publication Data

US 2003/0235416 A1 Dec. 25, 2003

(30) Foreign Application Priority Data

Jun. 21, 2002 (JP) ..... 2002-181892
Jul. 5, 2002 (JP) ..... 2002-197099

(51) Int. Cl.[7] ..... G03G 15/00; G03G 15/08; G03G 21/00

(52) U.S. Cl. ..... 399/27; 324/71.1; 324/658

(58) Field of Search ..... 399/27, 24, 53, 399/58, 59, 61; 324/71.1, 658, 686

(56) References Cited

U.S. PATENT DOCUMENTS 6,169,860 B1 * 1/2001 Curry et al. ..... 399/27 X
2002/0021908 A1 2/2002 Matsumoto et al. ..... 399/27
2002/0048463 A1 * 4/2002 Otomo et al. ..... 399/27
2002/0057918 A1 * 5/2002 Kojima et al. ..... 399/27
2002/0172521 A1 * 11/2002 Oguma et al. ..... 399/27
2003/0123888 A1 * 7/2003 Naito et al. ..... 399/27

FOREIGN PATENT DOCUMENTS

EP 1 143 305 A1 10/2001
JP 2001-290354 10/2001
JP 2001-290356 * 10/2001
JP 2003-005482 * 1/2003

* cited by examiner

*Primary Examiner*—Sophia S. Chen
(74) *Attorney, Agent, or Firm*—Fitzpatrick, Cella, Harper & Scinto

(57) ABSTRACT

In an image forming apparatus having a toner container, the remaining amount of toner is detected by measuring a capacitance caused by a toner detector member in the toner container. It is determined whether the measured capacitance falls within a predetermined range. If it is determined that the measured capacitance falls not within the predetermined range, the measured capacitance is not used in the detection of the remaining amount of toner. The present invention thus provides an image forming apparatus reliable in the detection of toner, and a method of controlling the apparatus.

13 Claims, 19 Drawing Sheets

IMAGE FORMING APPARATUS AND THE CONTROL METHOD INCLUDING A FEATURE OF DETECTING A REMAINING AMOUNT OF A DEVELOPER

BACKGROUND OF THE INVENTION

1. Field of the Invention

The present invention relates to an image forming apparatus using an electrophotographic image forming process and, more particularly, to an image forming apparatus and a method for controlling the image forming apparatus which includes a developer amount detector for successively detecting the remaining amount of developer in a developer container.

2. Description of the Related Art

Image forming apparatuses form an image on a recording medium using an electrophotographic process. The image forming apparatuses include an electrophographic copying machine, electrophotographic printer (such as an LED printer, and laser beam printer), electrophotographic facsimile device, and electrophotographic word processor.

A developing device may be a process cartridge into which a photoconductive structure as an image bearing body, a developing unit for supplying a developer to the photoconductive structure, and a cleaning unit for cleaning the photoconductive structure are integrated. The process cartridge is detachably mounted on the image forming apparatus. Alternatively, at least both a development unit and a developer container may be integrated into a development cartridge, which is detachably mounted on the image forming apparatus.

In the image forming apparatus using an electrophotographic process, light responsive to image information is directed to a photoconductive structure as an image bearing body to form a latent image. The development unit feeds a developer as a recording material to the latent image to develop a developer image. The developer image is then transferred to a recording medium. An image is thus formed on the recording medium.

The image forming apparatus of this type employs a process cartridge into which at least both a photoconductive structure and a development unit are integrated. The process cartridge is detachably mounted on the image forming apparatus. Since the user himself performs maintenance in this type of the image forming apparatus, operability of the apparatus is substantially improved. The process cartridge method is this widely used in the electrophotographic image forming apparatuses.

The developer contained in the developer container in the cartridge is consumed as the image forming apparatus forms images. When the developer is fully consumed, the user replaces the cartridge with a new cartridge to start over. It is necessary to let the user know regularly how much developer has been consumed and how much developer remains. Many image forming apparatuses are provided with a developer amount detector in the process cartridge thereof. The developer amount detector regularly detects the amount of developer to urge the user to prepare a new cartridge before an expected cartridge replacement time for appropriate and efficient cartridge replacement.

The developer amount detector disclosed in Japanese Patent Laid-open No. 2001-290354 proposes a developer amount detector. The developer amount detector includes two electrodes facing a developer bearing structure and a bottom surface of a developer container. A variation in a capacitance between each of the two electrodes and the developer bearing structure is detected. The developer amount detector detects the amount of developer within the developer container, and lets the user know the use status of the developer.

The method of detecting the remaining amount of developer by measuring a capacitance between a plurality of electrodes and a developer bearing structure in the conventional developer amount detector having the above-referenced construction requires a relatively simple circuit and results in fairly accurate measurements. For this reason, a variety of developer amount detectors have been proposed. The conventional developer amount detector includes the two electrodes to cover a wide detection range of developer. The distance between each electrode and the developer bearing structure becomes far depending on the construction of the developer container if the volume of the developer within the cartridge is increased. When the capacitance between the electrode and developer bearing structure is measured, the detected capacitance is more subject to noise. If the electrode is influenced by external noise (in the form of electromagnetic interference generated in other electronics), or if no correct voltage is applied to the electrode (antenna) in the cartridge as a result of a foreign matter (such as staples) introduced into the apparatus, no correct detected value is obtained. The conventional developer amount detector detects an erroneous developer amount.

SUMMARY OF THE INVENTION

The object of the present invention is to provide an image forming apparatus which is free from erratic detection of the remaining amount of developer even under the presence of external noise or noise caused by the introduction of a foreign matter into the apparatus when the remaining amount of developer within a development unit is detected. Another object of the present invention is to provide a method of controlling the image forming apparatus.

In a first aspect of the present invention, an image forming apparatus having a developer container containing a developer, a developer supply member for supplying the developer from the developer container to an image bearing member, and a detector member for detecting the amount of the developer, includes a detector for detecting a value corresponding to a capacitance between the detector member and the developer supply member, and a processor for processing the value detected by the detector, wherein the processor determines whether the detected value falls within a predetermined range, and avoids using the detected value in the processing if the detected value corresponding to the capacitance falls not within the predetermined range.

In a second aspect of the present invention, an image forming apparatus having a developer container containing a developer, a developer supply member for supplying the developer from the developer container to an image bearing member, and first and second detector members for detecting the amount of the developer, includes a storage unit for storing information relating to the developer, a first detector for detecting a value corresponding to a capacitance between the first detector member and the developer supply member, a second detector for detecting a value corresponding to a capacitance between the second detector member and the developer supply member, and a processor for storing the values detected by the first and second detectors, respectively, wherein the processor avoids storing the detected values if the detected values are in a predetermined state.

In a third aspect of the present invention, an image forming apparatus having a developer container containing a developer, a developer supply member for supplying the developer from the developer container to an image bearing member, and first and second detector members for detecting the amount of the developer, includes a storage unit for storing information relating to the developer, a first detector for detecting a value corresponding to a capacitance between the first detector member and the developer supply member, a second detector for detecting a value corresponding to a capacitance between the second detector member and the developer supply member, and a calculator for calculating the amount of the developer in the developer container based on a plurality of values which are detected by one of the first and second detectors during a predetermined period of time, wherein the calculator compares the plurality of values detected during the predetermined period of time with a predetermined threshold, and avoids using in the calculation of the amount of the developer any one of the plurality of values that is determined to be equal to or below the threshold.

In a fourth aspect of the present invention, a method of controlling an image forming apparatus having a developer container containing a developer, a developer supply member for supplying the developer from the developer container to an image bearing member, and a detector member for detecting the amount of the developer, includes the steps of detecting a value, corresponding to a capacitance between the detector member and the developer supply member and relating to the amount of the developer in the developer container, determining whether the value detected in the detecting step falls within a predetermined range, processing the value detected in the detecting step, and controlling the processing step to avoid using the detected value if it is determined in the determining step that the detected value falls not within the predetermined range.

In a fifth aspect of the present invention, a method for controlling an image forming apparatus having a developer container containing a developer, a developer supply member for supplying the developer from the developer container to an image bearing member, first and second detector members for detecting the amount of the developer, and a storage unit for storing information relating to the developer, includes a first step of detecting a value corresponding to a capacitance between the first detector member and the developer supply member and a value corresponding to a capacitance between the second detector member and the developer supply member, a second step of storing the values, detected in the first step, in the storage unit, and a third step of avoiding storing the detected values if the values detected in the first step are at a predetermined state.

In a sixth aspect of the present invention, a method for controlling an image forming apparatus having a developer container containing a developer, a developer supply member for supplying the developer from the developer container to an image bearing member, first and second detector members for detecting the amount of the developer, and a storage unit for storing information relating to the developer, includes a first step of detecting a value corresponding to a capacitance between the first detector member and the developer supply member and a value corresponding to a capacitance between the second detector member and the developer supply member, a second step of calculating the amount of the developer within the developer container based on a plurality of values which are detected by one of the first and second detector members during a predetermined period of time, a third step of comparing each of the plurality of values detected during the predetermined period of time with a predetermined threshold, and a fourth step of avoiding using, in the calculation in the second step, any one of the plurality of detected values which is determined to be equal to or smaller than the predetermined threshold.

Further objects, features, and advantages of the present invention will be apparent from the following description of the preferred embodiments with reference to the attached drawings.

DESCRIPTION OF THE PREFERRED EMBODIMENTS

The preferred embodiments of the present invention are discussed in detail below with reference to the drawings. The elements of the embodiments to be discussed below are for exemplary purposes only, and the present invention is not limited to these elements.

First Embodiment

Figure 1:
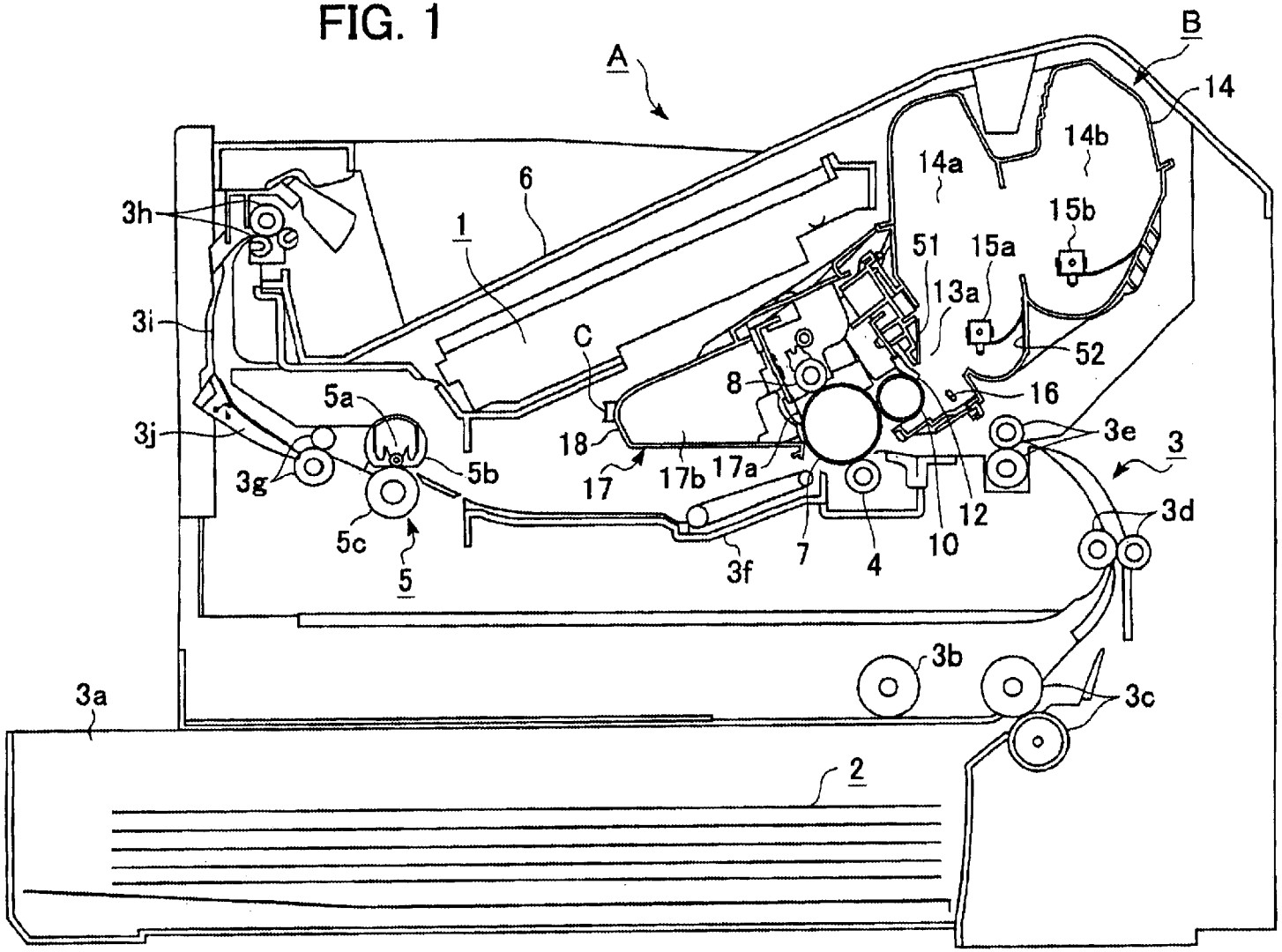
FIG. 1 diagrammatically shows an image forming apparatus of first and second embodiments of the present invention.
Figure 2:
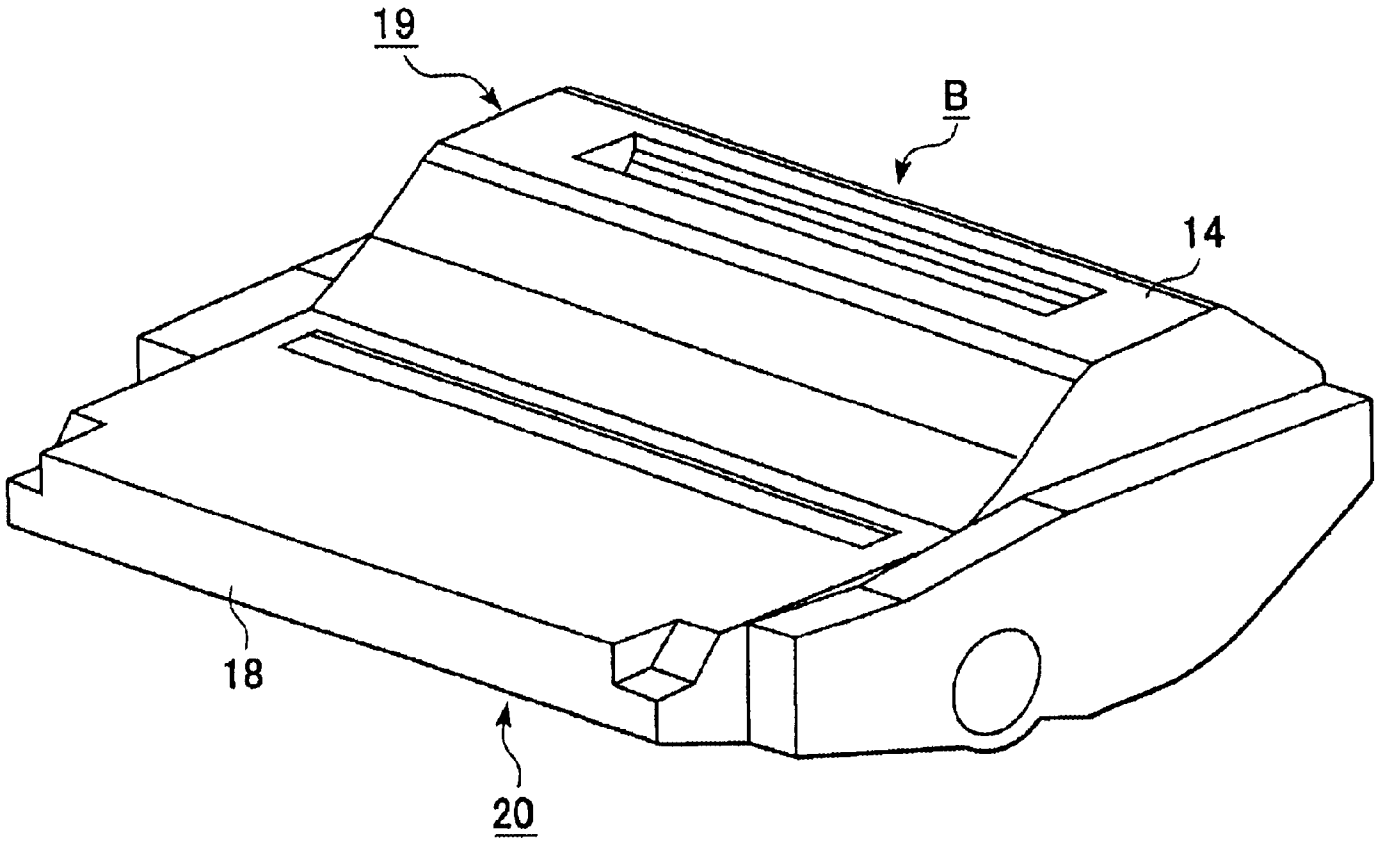
FIG. 2 is an external perspective view of a process cartridge of the first and second embodiments of the present invention.
Figure 3:
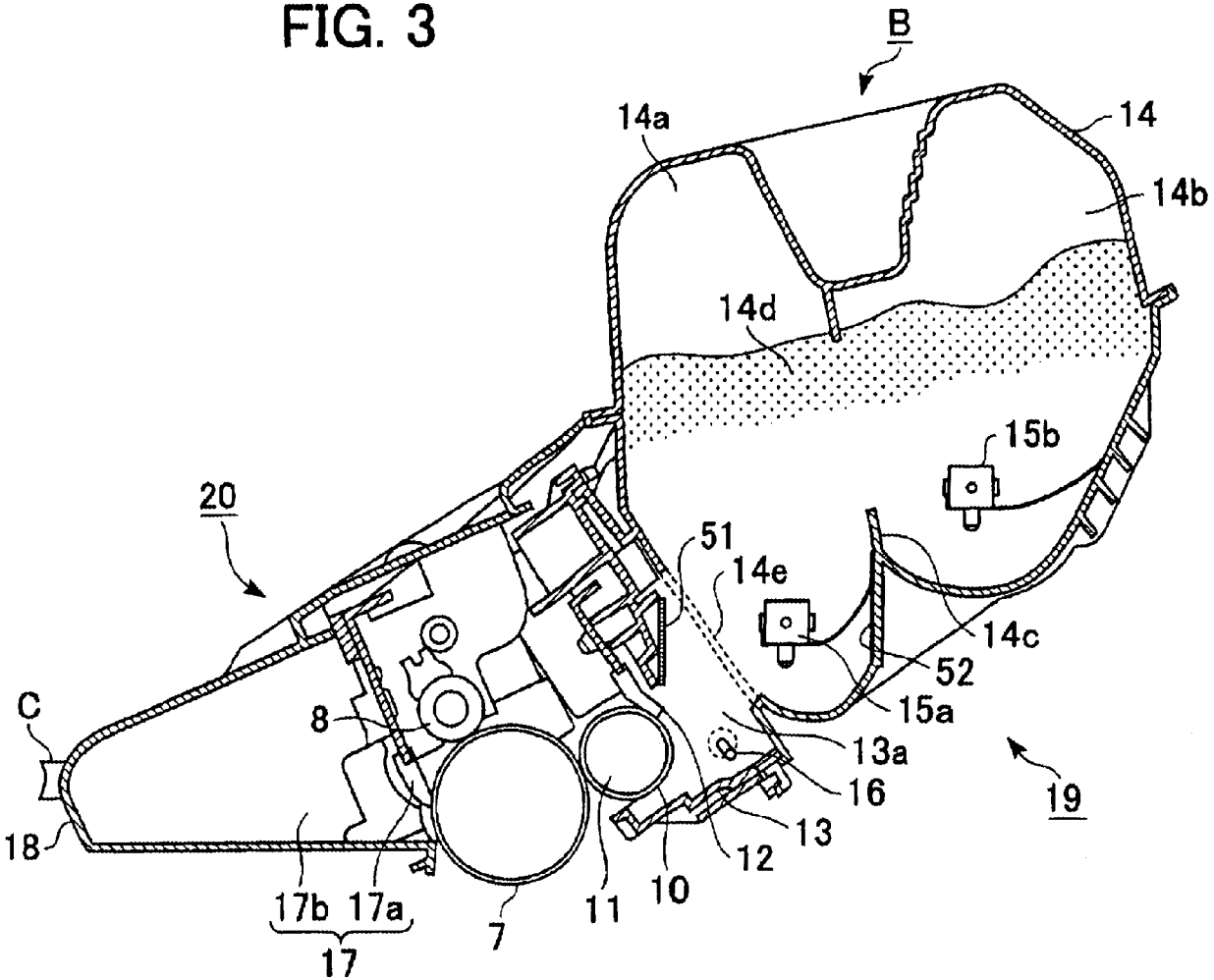
FIG. 3 is an elevational sectional view of the process cartridge.
Figure 4:
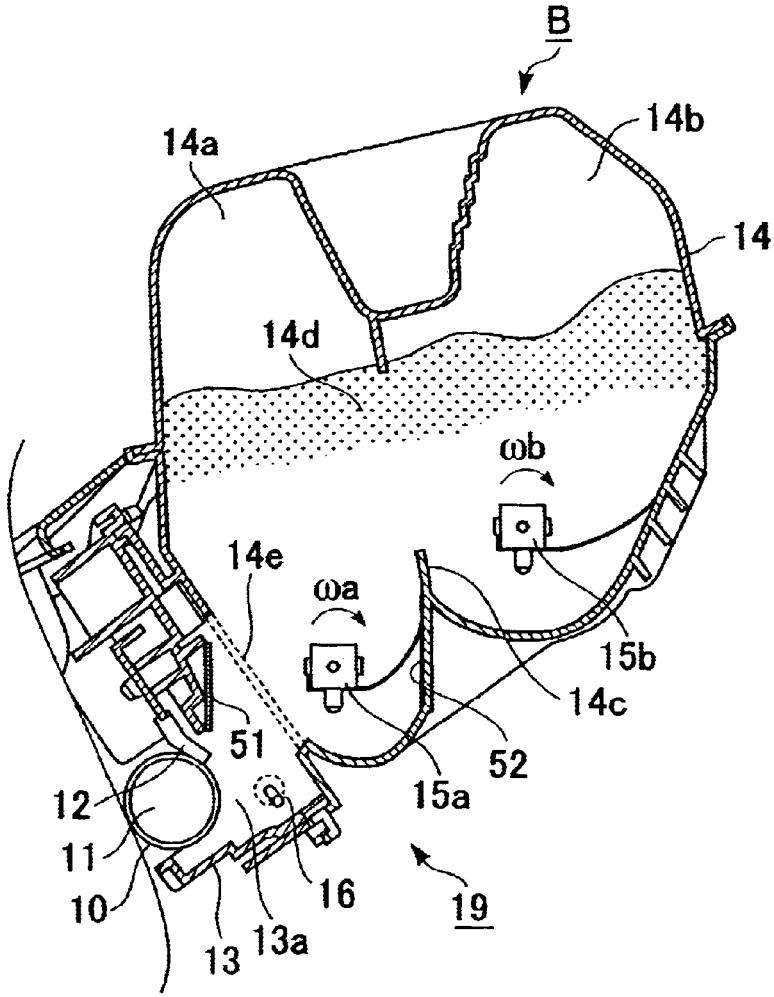
FIG. 4 shows a development unit enlarged in an elevational sectional view of the process cartridge in accordance with the first and second embodiments of the present invention.
Figure 5:
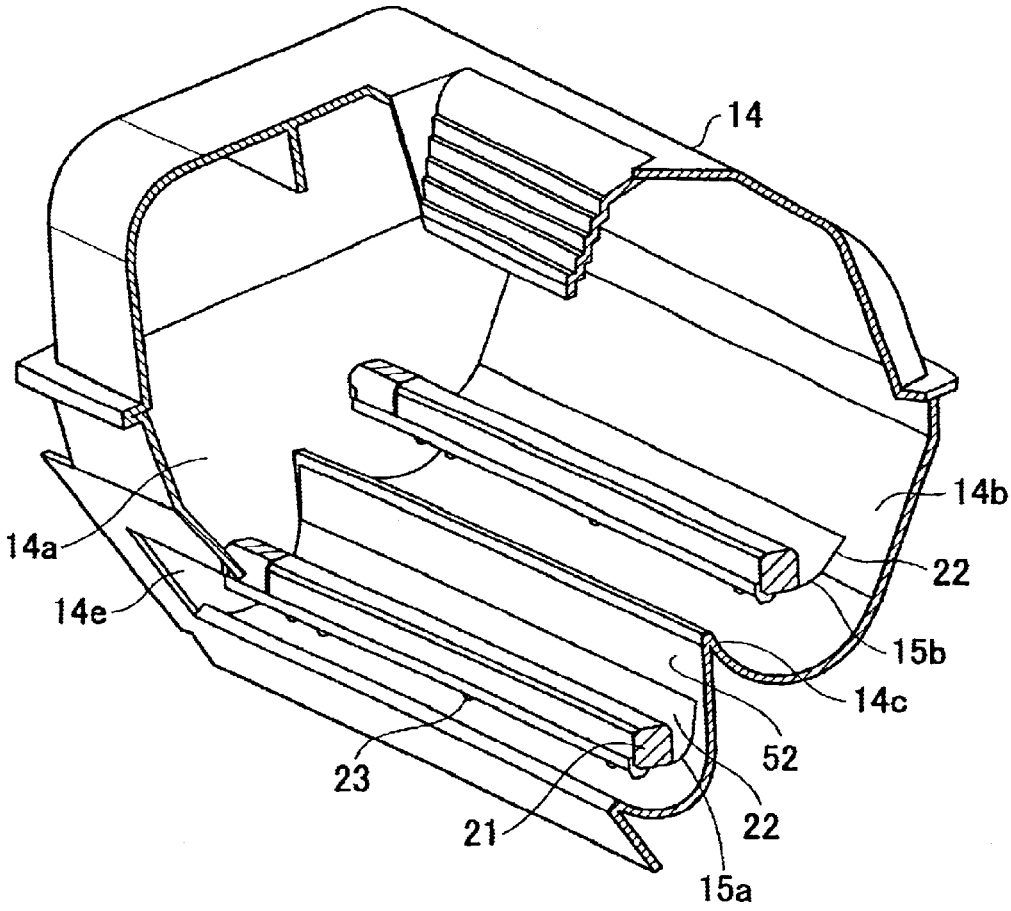
FIG. 5 is a perspective view of a developer container of the process cartridge in accordance with the first and second embodiments with a portion thereof broken away.

FIG. 1 diagrammatically shows an image forming apparatus of a first embodiment of the present invention. FIG. 2 is an external perspective view of a process cartridge of the first embodiment of the present invention. FIG. 3 is an elevational sectional view of the process cartridge. FIG. 4 shows a development unit enlarged in an elevational sectional-view of the process cartridge in accordance with the first embodiment of the present invention. FIG. 5 is a perspective view of a developer container of the process cartridge in accordance with the first embodiment with a portion thereof broken away.

Referring to FIGS. 1 through 3, the image forming apparatus having a development unit (such as a process cartridge) detachably mounted thereon will now be discussed. The image forming apparatus is an electrophotographic laser beam printer in the first embodiment.

The image forming apparatus having a development unit detachably mounted thereon is not limited to the laser beam printer. The image forming apparatus may be another apparatus such as a copying apparatus or facsimile machine.

An image forming apparatus A includes a drum-like electrophotographic photosensitive structure (hereinafter simply referred to as a photoconductive drum) 7. The photoconductive drum 7 is charged by a charging roller 8 as charging means. An optical assembly 1 including a laser diode, polygon mirror, lens, and reflective mirror directs a laser beam to the photoconductive drum 7 in accordance with picture information, thereby forming a latent image on the photoconductive drum 7. A development unit develops the latent image into a visible image, i.e., a developer image using a developer.

The development unit includes a development sleeve 10 as a developer bearing structure, development blade 12 as a developer amount restraining member for triboelectrically imparting charge on a developer on the surface of the development sleeve 10 and for forming a developer layer to a predetermined thickness on the development sleeve 10, and magnet roller 11 housed in the development sleeve 10. These elements are mechanically supported by a development frame structure 13. The development frame structure 13 is welded to a developer container 14 in a unitary body, thereby forming a development unit 19.

Arranged inside the developer container 14 are agitators 15*a* and 15*b* which agitate a developer while conveying the developer to a development room 13*a* at the same time. With the agitators 15*a* and 15*b* rotating, the developer in the developer container 14 is moved to the development sleeve 10 in the development room 13*a*. A developer agitator 16 is arranged in the vicinity of the development sleeve 10 in the development frame structure 13. The developer is thus circulated in the development room 13*a*.

In the above arrangement, the developer in the developer container 14 is conveyed to the development room 13*a* by the rotating agitators 15*a* and 15*b*. The developer conveyed to the development room 13*a* is then agitated by the developer agitator 16 while being supplied to the development sleeve 10. The developer adheres to the surface of the development sleeve 10 having the magnet roller 11 therewithin, and is then moved together with the rotating development sleeve 10. The developer adhering to the development sleeve 10 is then triboelectricaly charged and deposited as a developer layer having a predetermined thickness on the development sleeve 10 by the development blade 12, and is then conveyed to a development area of the photoconductive drum 7. The developer reaching the development area is transferred to a latent image on the photoconductive drum 7, thereby becoming a developer image. The development sleeve 10, connected to a development bias circuit, is supplied with a development bias voltage which is formed of a direct current with a alternating current superimposed thereon.

A storage unit C for storing information is arranged in the process cartridge B. The storage unit C stores information concerning the process cartridge B, such as information indicating whether the process cartridge B is new or not, amount of the developer in the process cartridge B (the remaining amount or the used amount of the developer), usage history of the process cartridge B (the number of prints, date and time of use), and identification information (such as a serial number).

Since the process cartridge B is detachable, appropriate print control is carried out by referencing the information stored in the storage unit C such as the remaining amount of toner even if the process cartridge B is detached in the middle of use and is then mounted again.

The storage unit C may be a non-volatile memory such as an EEPROM or a magnetically storable memory, and may be any memory as long as it stores information in a non-volatile fashion.

A recording medium 2 set in a feeder cassette 3*a* is conveyed to a transfer position through a pickup roller 3*b*, and conveyance roller pairs 3*c*, 3*d*, and 3*e* in synchronization with the formation of the developer image. A transfer roller 4 as transfer means is arranged at the transfer position. By applying a voltage to the transfer roller 4, the developer image is transferred from the photoconductive drum 7 to the recording medium 2.

The recording medium 2 now having the developer image transferred thereon is conveyed to a fixing unit 5 through a conveyance guide 3*f*. The fixing unit 5 includes a fixing roller 5*b* having a driving roller 5*c* and heater 5*a* therewithin. The fixing unit 5 applies heat and pressure on the recording medium 2 passing therealong in order to transfer the developer image onto the recording medium 2. The recording medium 2 is then conveyed by discharge roller pairs 3*g* and 3*h*, and is then discharged to an output tray 6 through a reversal passage 3*i*. The output tray 6 is arranged on the upper portion of the image forming apparatus A. A flapper 3*j* may be used to discharge the recording medium 2 rather than using the reversal passage 3*i*. A conveyance assembly 3 of the recording medium 2 includes the pickup roller 3*b*, conveyance roller pairs 3*c*, 3*d*, and 3*e*, conveyance guide 3*f*, and discharge roller pairs 3*g* and 3*h*.

A cleaning unit 17 removes developer residing on the photoconductive drum 7 after the developer image is transferred to the recording medium 2 by the transfer roller 4. The photoconductive drum 7 then starts a next image forming cycle. With a flexible cleaning blade 17*a* arranged to be in contact with the photoconductive drum 7, the cleaning unit 17 scrapes off the residual developer from the photoconductive drum 7, and collects the scraped developer into a removed developer reservoir 17*b*.

The process cartridge B detachably mounted on the image forming apparatus A thus constructed is discussed with reference to FIGS. 2 and 3. The process cartridge B includes the development unit 19 and photoconductive unit 20. The development unit 19 is formed by welding the developer container 14 containing the developer and with the agitators 15*a* and 15*b* arranged therewithin, to the development frame structure 13 holding the developing members such as the development sleeve 10 and development blade 12. The photoconductive unit 20 is formed by attaching the photoconductive drum 7, cleaning unit 17, including the flexible cleaning blade 17*a*, and the charging roller 8 to a drum support frame 18. The development unit 19 and photoconductive unit 20 are integrated into a cartridge as shown in FIG. 2.

The construction of the developer container 14 of the first embodiment is discussed further in detail with reference to FIGS. 3 through 5.

The developer container 14 is divided into two container sections 14*a* and 14*b*. A bottom partition 14*c* is formed where the bottoms of the two container sections 14*a* and 14*b* join. The bottom partition 14*c* restrains the height to which the developer is scooped up from the container section 14*b*. The developer is supplied from the container section 14*b* to the container section 14*a* through an opening 14*d*. The agitators 15*a* and 15*b* are arranged in the container sections 14*a* and 14*b*, respectively. The agitator 15*a* closer to the development sleeve 10 (i.e., in the container section 14*a* next to the development room 13*a*) is arranged at a position relatively lower in level than the container section 15*b*. In this arrangement, the developer drops through the opening 14*d* by its own weight, and subsequent conveyance of the developer is smoothly performed.

As shown in FIG. 5, the agitator 15*a* is formed of a rotary bar 21, flexible sheet 22 made of polyphenylene sulfide, and pressure member 23. The flexible sheet 22 is secured to the rotary bar 21 using screws, bonding agent, welding, or heat caulking. The agitator 15*b* is identical to the agitator 15*a*.

The agitator 15*b* in the container section 14*b* rotates in a direction represented by an arrow as shown in FIG. 4, thereby agitating the developer in the container section 14*b*, and supplying the developer to the container section 14*a* through the opening 14*d*. The agitator 15*a* in the container section 14*a* rotates in a direction represented by an arrow as shown in FIG. 4, thereby agitating the developer in the container section 14*a*, and supplying the developer into the development room 13*a* of the development frame structure 13 through a supply opening 14*e*. The rotational speeds of the agitators 15*a* and 15*b* are ωa and ωb, respectively, and the relationship of ωa>ωb holds. The rotational speed ωa of the agitator 15*a* in the container section 14*a* next to the development room 13*a* is set to be higher to facilitate the supply of the developer to the development sleeve 10. The rotational speed ωb of the agitator 15*b* far from and upstream of the development room 13*a* is set to be lower within a range that permits the developer to be supplied to the container section 14*a*. The degradation of the developer due to excessive agitation in a position far from the development sleeve 10 is thus controlled. In the first embodiment, the rotational speed ωa is set to be about twice as high as the rotational speed ωb. If the agitators are not adjusted to be out of phase to each other at initial setting, the rotational speeds ωa and ωb are prevented from being set in an integer multiple of one to the other so that the agitator are free from continuous phase matching.

The single developer container 14 is divided into the two container sections 14*a* and 14*b* by the bottom partition 14*c*, and the agitators 15*a* and 15*b* are arranged in the container sections 14*a* and 14*b*, respectively so that the developer is scooped up to the height of the bottom partition 14*c*. The weight of the mass of the developer is distributed, and an increase in torque due to the aggregation of the developer in transit (the developer becomes solidified in a localized area if the cartridge is left unused for a long time) is controlled.

The downstream agitator 15*a* is located at a position relatively lower than the upstream agitator 15*b* so that the flow of the developer to the downstream container section 14*a* is retrained by the opening 14*d*. Since the rotational speed of the downstream agitator 15*a* is set to be higher than that of the upstream agitator 15*b* (ωa>ωb), the upstream container section 14*b* far from the development sleeve 10 is free from excessive agitation, thereby achieving the purpose of storage of developer without quality degradation and over-supply involved. The downstream container section 14*a* assures a circulation of the developer, thereby supplying the developer to the development sleeve 10 in a stable manner.

As shown in FIGS. 4 and 5, the process cartridge B of the first embodiment includes a first electrode 51 near the development sleeve 10 and a second electrode 52 within the developer container 14. With a voltage applied to the development sleeve 10, a capacitance between each of the two electrodes 51 and 52 and the development sleeve 10 is detected in the form of voltage. The detected voltage value corresponds to the amount of the developer. The amount of the developer in the developer container 14 is precisely detected by detecting the voltage value corresponding to the capacitance.

The first electrode 51 and second electrode 52 are used to successively detect the amount of developer within a predetermined range in the developer container 14. For example, the first and second electrodes 51 and 52 are arranged in the developer container 14 so that the second electrode 52 serves the purpose of detecting 10% to 25% of a full amount of developer and so that the first electrode 51 serves the purpose of detecting less than 10% of the full amount of the developer.

When the process cartridge B is really new or at the initial phase of use of a new cartridge, in other words, when the developer container 14 is full of the developer, the capacitance between each of the first electrode 51 and second electrode 52 and the development sleeve 10 is detected in the form of voltage. The measurements are then stored in the storage unit C in the process cartridge B as the full amount of developer.

Figure 6:
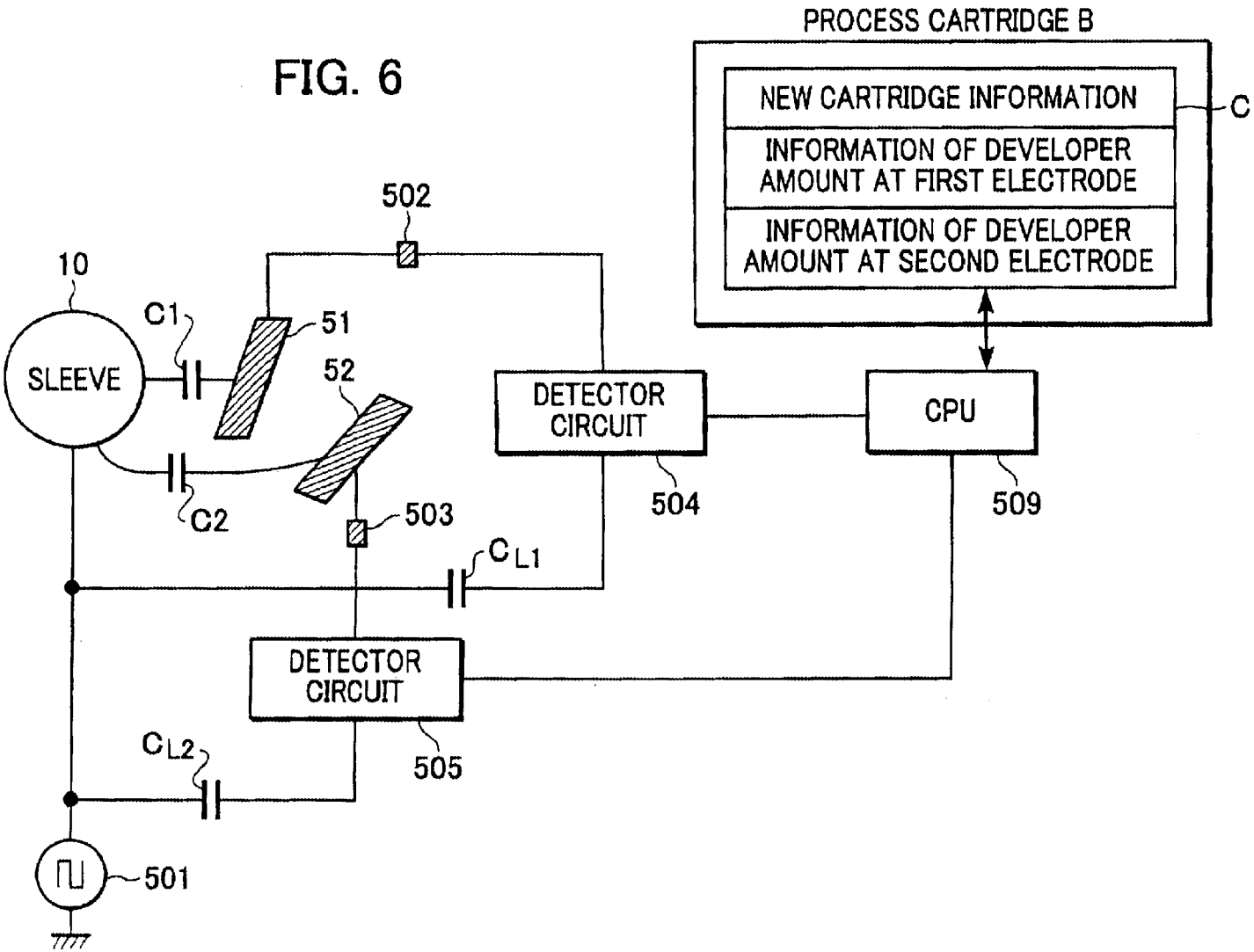
FIG. 6 is a block diagram of the process cartridge of the first and second embodiments of the present invention.
Figure 7:
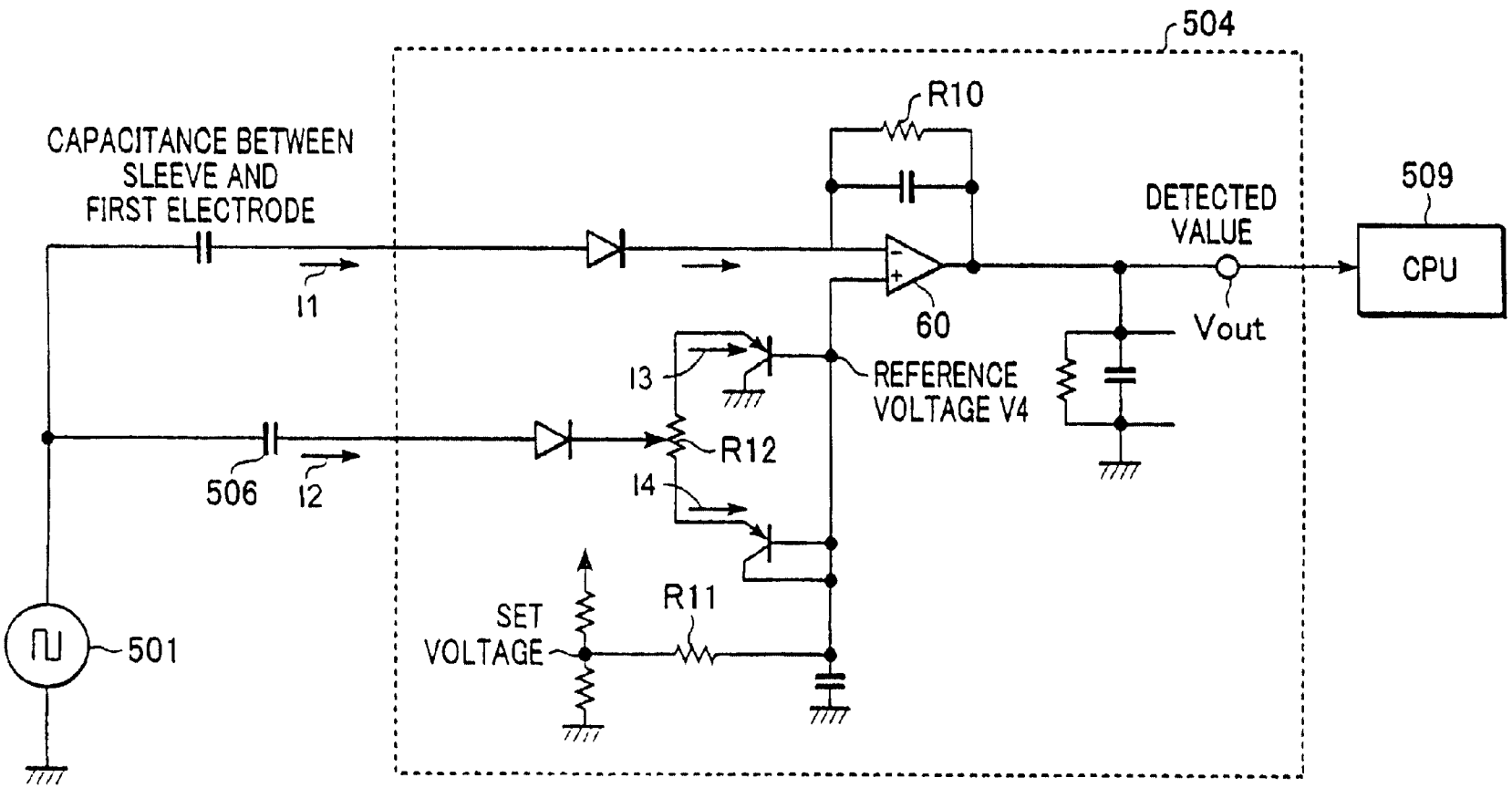
FIG. 7 is a circuit diagram of a developer amount detector in accordance with the first and second embodiments of the present invention.
Figure 8:
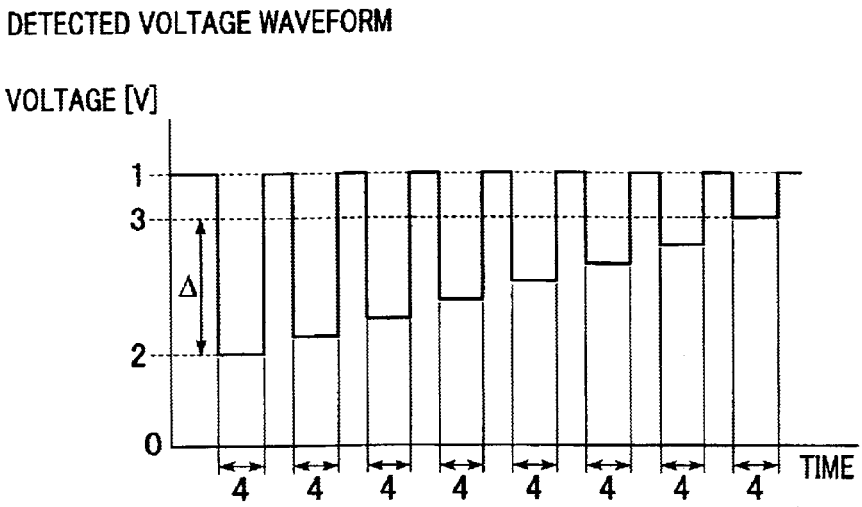
FIG. 8 is a waveform diagram of an output voltage in response to the amount of developer in accordance with the first embodiment of the present invention.

A method of detecting the amount of developer in the first embodiment of the present invention will now be discussed with reference to FIGS. 6, 7, and 8.

The first electrode 51 is discussed first. FIG. 6 is a block diagram of a developer amount detector. As shown, a developer circuit 501 is connected to a capacitor 506 which serves as a reference of a capacitance between the development sleeve 10 and the first electrode 51. The first electrode 51 is connected to a detector circuit 504 via a contact point 502 (point 1). The reference capacitor CL1 is connected to the detector circuit 504. The second electrode 52 is connected to a detector circuit 505 via a contact point 503. The reference capacitor CL2 is connected to the detector circuit 505. FIG. 7 shows in detail the detector circuit 504 for detecting the amount of developer. As shown, the developer circuit 501 for applying a development bias is connected to the reference capacitor 506. The reference capacitor 506 is in turn connected to the detector circuit 504, and allows a current I2 to flow therethrough. Currents I3 and I4 are branched off from the current I2 through a potentiometer R12. A reference voltage V4 is determined by the branch current I4, resistor R11, and set voltage. (The reference voltage V4 is a voltage that is determined by summing the voltage caused across the resistor R11 in response to the current I4 and the set voltage).

The developer circuit 501 is connected to the development sleeve 10, which is in turn connected to the detector circuit 504 through the first electrode 51. An operational amplifier 60 outputs the amount of developer as a detected output voltage Vout (V4−I4×R10) to a CPU 509. FIG. 8 shows a waveform of the voltage detected in response to the amount of developer. A new cartridge is inserted into the image forming apparatus, a printing operation starts, and the detected voltage becomes the one at a level 2 as shown in FIG. 8. The level 2 refers to the detected voltage corresponding to the amount of developer. The level 2 voltage is determined by detecting the voltage for a constant period of time, summing the detected voltages, and then averaging the sum of the voltages.

In the averaging operation, 100 pieces of voltage data obtained during a predetermined period of time are summed and then averaged. The present invention is not limited to this method. The number of voltage detections may be appropriately changed.

A detector circuit 505 is identical to the detector circuit 504 in construction.

The minimum voltage value of the averaged detected voltage 2 is temporarily stored in a memory (an RAM (not shown) or a non-volatile memory (not shown)) in the CPU 509 as a value set for the full amount of the developer. In response to an instruction from the CPU 509, the value set for the full amount of the developer stored in the memory is written onto a memory in the process cartridge B at a predetermined timing. When the process cartridge B is used with the developer reduced in amount, the voltage level becomes a voltage level 3 that notifies the user of a reduction in the amount of the developer. The voltage level setting is determined based on a change (Δ) from the value set for the full amount of the developer stored in the memory in the CPU 509. When the image forming apparatus prints the sheets more with the developer reduced in amount, and the voltage reaches a voltage level 3, the CPU 509 determines that the amount of the developer is small. The second electrode 52 works in the same mechanism as the first electrode 51. When a brand new cartridge is inserted into the image forming apparatus, the second electrode 52 detects a voltage value for the full amount of developer. The detected voltage value is stored in the memory in the CPU 509. The detected voltage value is then stored in the storage unit C in the process cartridge B.

Figure 9A:
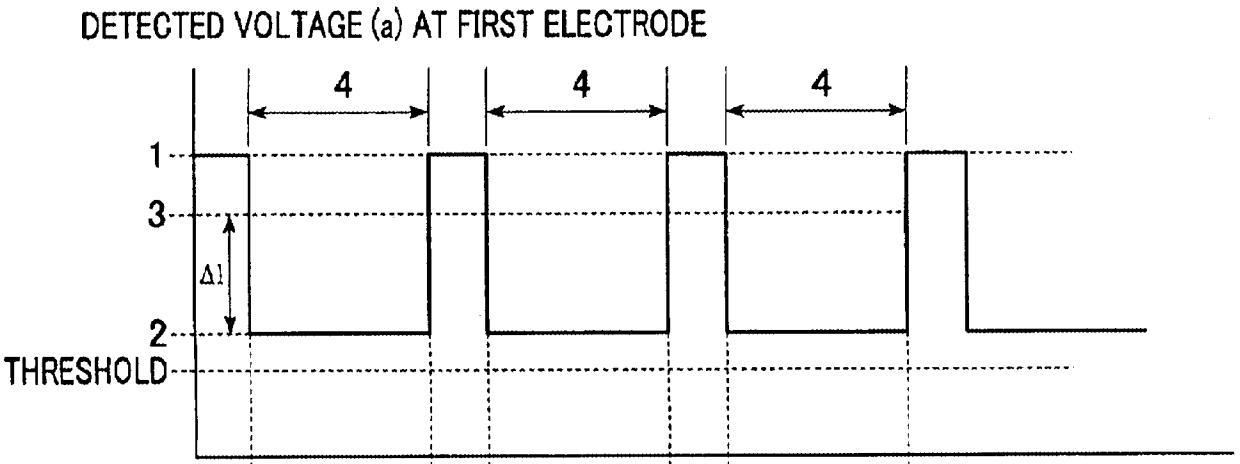
FIGS. 9A and 9B are waveform diagrams of an output in response to the amount of developer in accordance with the first embodiment of the present invention.
Figure 9B:
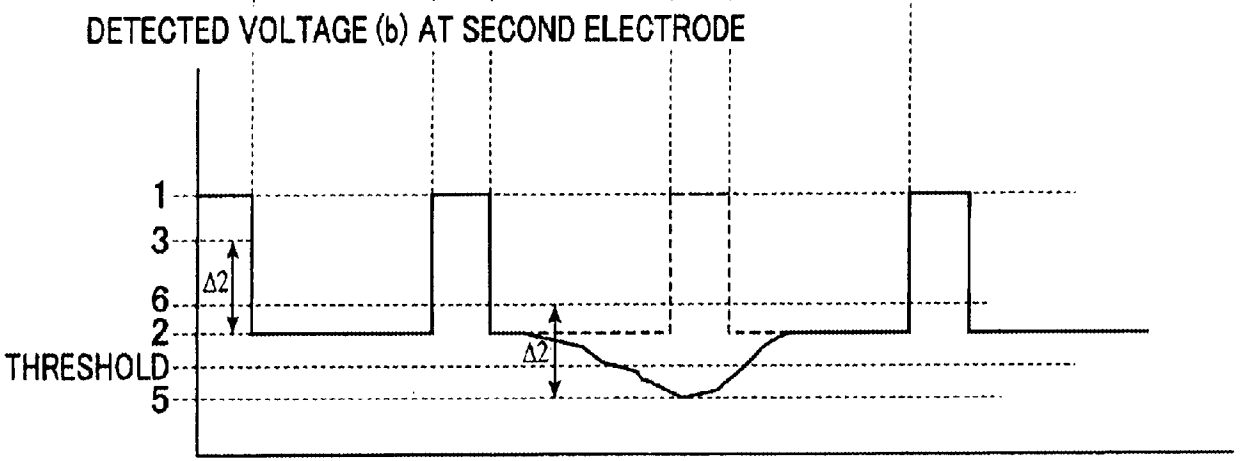

An error prevention method in the detection of the developer in the first embodiment is discussed below with reference to FIGS. 9A and 9B. FIG. 9A indicates a voltage level detected by the first electrode 51, and FIG. 9B indicates a voltage level detected by the second electrode 52. The detected voltages are output to and then processed by the CPU 509. The discussion of the voltage levels is identical to that of FIG. 8. FIGS. 9A and 9B are waveform diagrams of output voltages form the first electrode 51 and second electrode 52 with external noise generated. The voltage detected by the second electrode 52 shown in the FIG. 9B drops below the voltage level 2 due to noise, and goes down to a voltage level 5 below a threshold (the noise free waveform is represented by a broken line). When the voltage level 5 below the threshold lasts for a constant period of time, the resulting value subsequent to the averaging operation by the CPU 509 naturally becomes lower than the threshold. Here, Δ1 is a variation of the voltage level detected by the first electrode and represents a variation from the value set for the full amount of developer.

When the detected voltage of one of the first electrode 51 and second electrode 52 is below the respective threshold, the detected voltage is considered subject to noise. The detected voltage is neither treated as the one for the full amount of developer, nor is it stored in the memory in the CPU 509.

If such a determination process is not performed, the voltage level 5 is stored as a value set for the full amount of developer. A voltage level 6 higher than the level set for the full amount of developer by a change Δ2 is erratically detected as a signal indicating no developer in the container. The voltage level 6 is close to the full amount of developer in fact. When the detected voltage of the developer in one of the first electrode 51 and second electrode 52 is lower than the threshold, the value set for the full amount of developer is not stored in the CPU 509. In this way, an error in the voltage detection due to noise is prevented The threshold is set taking into consideration a slight amount of error resulting from variations in the mounting position of the first electrode 51 and second electrode 52 in the process cartridge B, and an error in the voltage value corresponding to the capacitance detected subsequent to a long unused period of time. If the detected voltage falls within the threshold, the detected voltage is considered free from the influence of noise.

Figure 10:
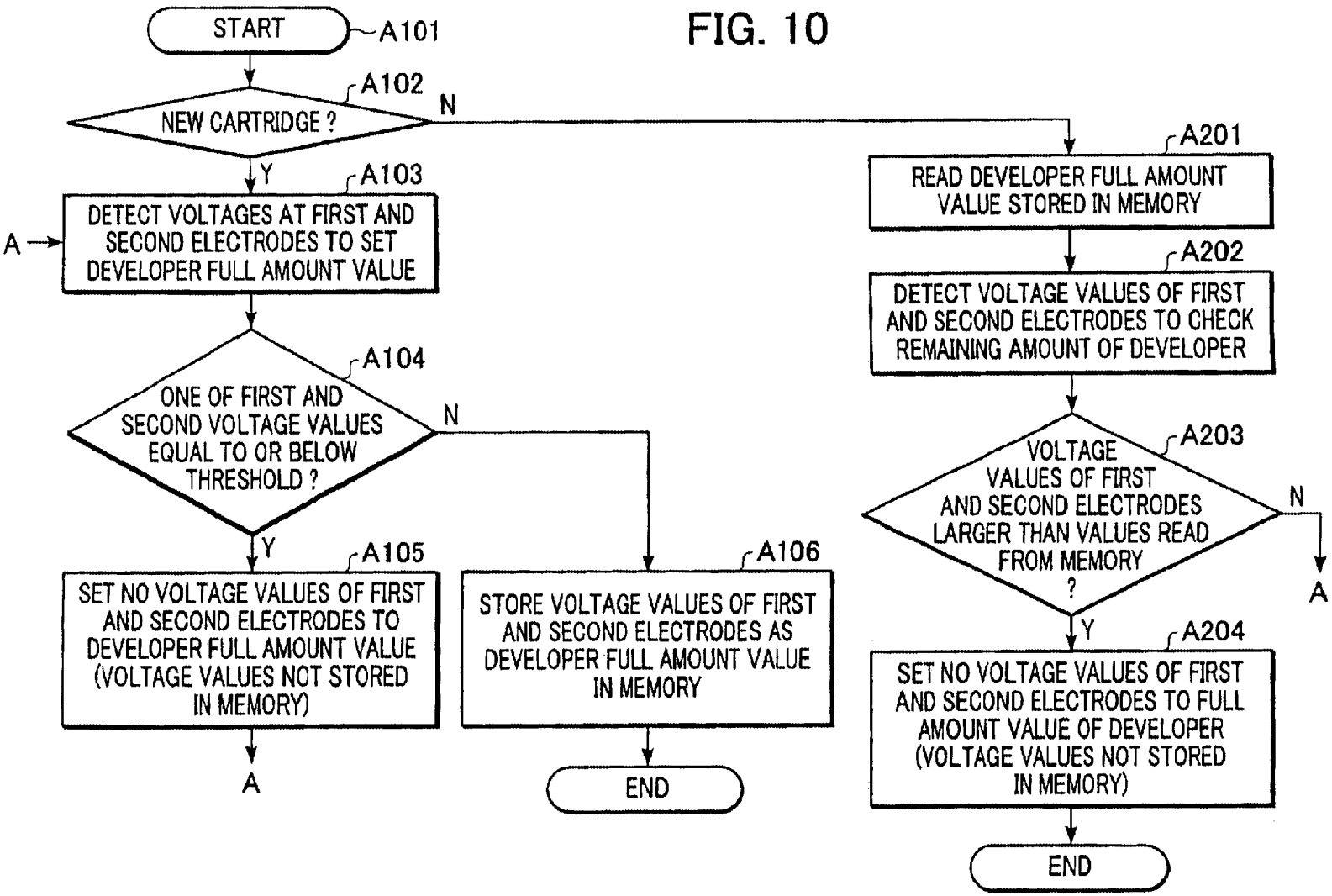
FIG. 10 is a flow diagram of the first embodiment of the present invention.

A noise removal method of the present invention will be discussed with reference to a flow diagram for detecting the full amount of developer shown in FIG. 10.

The detection of the full amount of developer starts at a timing, for example, at the moment the process cartridge B is installed (A101). In step A102, the CPU 509 checks whether or not the process cartridge B installed in step A101 is new (the new cartridge information indicating that the process cartridge B is new is read from the memory of the process cartridge B in response to a command from the CPU 509). If the process cartridge B is new, a voltage is applied to the development sleeve 10 to detect the amount of developer in the process cartridge B, and the capacitance between the development sleeve 10 and each of the first electrode 51 and second electrode 52 is detected in the form of voltage (A103). The detected voltage values are compared with the respective thresholds to determine whether each voltage value is equal to or smaller than the respective threshold (A104). If the detected voltage value is equal to or smaller than the threshold, the voltage values detected by the first electrode 51 and second electrode 52 are not regarded as the values for the full amount of developer, and are not stored in the memory of the CPU 509 (A105). The algorithm loops to step A103 (A) to detects the voltage values at the first electrode 51 and second electrode 52. If the voltage values respectively detected by the first electrode 51 and second electrode 52 are above their respective thresholds, the voltage values respectively detected by the first electrode 51 and second electrode 52 are stored in the memory of the CPU 509 as the developer full amount values. The developer full amount values are then stored in the storage unit C in the process cartridge B (A106). The developer amount detection thus ends. As shown in FIG. 6, the storage unit C has areas for storing new cartridge information indicating that the process cartridge B is new, information of developer amount detected at the first electrode 51 (detected voltage value), and information of developer amount detected at the second electrode 52 (detected voltage value).

If it is determined in step A102 that the process cartridge B is not new, the CPU 509 reads the full amount of developer information corresponding to the first electrode 51 and second electrode 52 stored in the storage unit C in the process cartridge B, and temporarily stores the full amount information in the memory of the CPU 509 (step A201). A voltage is applied to the development sleeve 10 to detect the developer amount in the process cartridge B, and the capacitance between the development sleeve 10 and each of the first electrode 51 and second electrode 52 is detected in the form of voltage (step A202). The voltage values detected in step A202 are compared with the developer full amount values for the first electrode 51 and second electrode 52 read in step A201 to determine whether the detected voltage values are respectively larger than the read values (step A203). If it is determined that the detected voltage values are larger, the image forming apparatus must have used the developer to an amount smaller than the full amount thereof. It is thus determined that the first and second detected voltage values do not correspond to the full amount values, and the detected voltage values are not stored in the memory of the CPU 509 (step A204). (The detected voltage values are not stored in the storage unit C in the process cartridge B, either). If it is determined that the detected voltage values are smaller, the amount of developer is larger than the full amount value previously detected. The developer full amount value is determined again (the algorithm loops back to step A103(A)).

The developer full amount values are updated after the developer full amount values are detected and stored in this way. This is because the developer full amount value which is detected subsequent to a long unused period of the process cartridge B is slightly different from the developer full amount value which is detected subsequent to the agitation of the developer in the initialization process of the apparatus.

Second Embodiment

Figure 11:
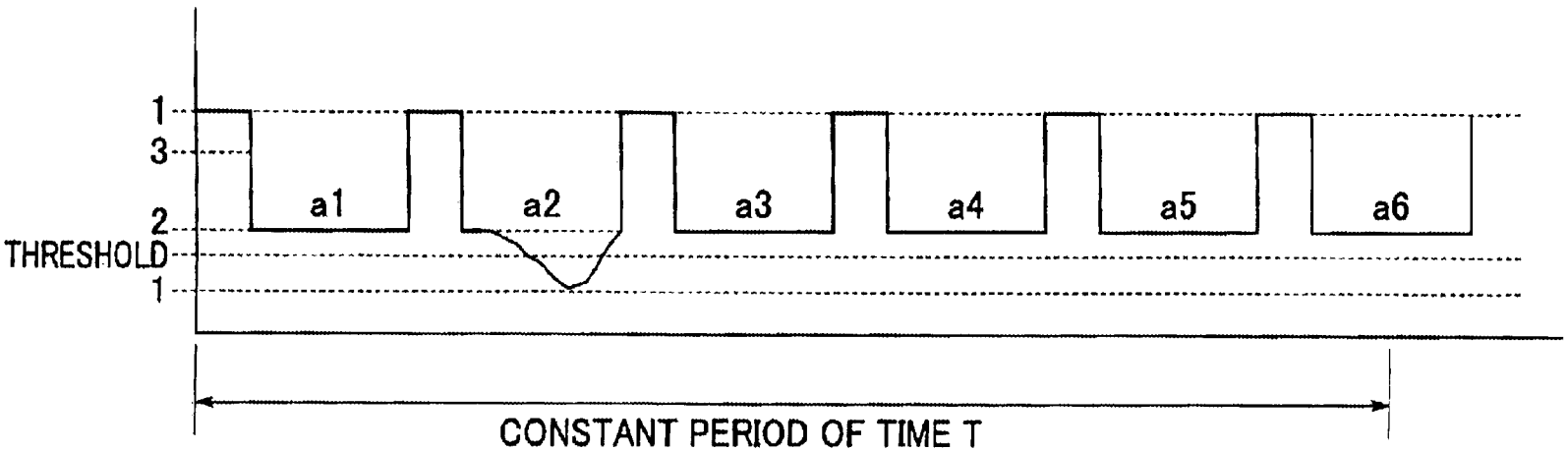
FIG. 11 is a waveform diagram of an output in response to the amount of developer in accordance with the second embodiment of the present invention.

A second embodiment of the present invention will be discussed with reference to FIG. 11. Only the difference of the second embodiment from the first embodiment will be discussed. In the discussion of the second embodiment, elements identical to those used in the first embodiment are designated with the same reference numerals.

The second embodiment controls an error in the detection of the developer amount when one of the first electrode 51 and second electrode 52 is influenced by noise.

The developer amount detection method in the second embodiment remains unchanged from that in the first embodiment. The error prevention method in the detection of the developer in accordance with the second embodiment will be discussed with reference to FIG. 11. FIG. 11 shows the waveform of an output voltage corresponding to the developer amount at the second electrode 52, wherein a level 1 is a voltage which is detected at the second electrode 52 when the process cartridge B is mounted.

The development sleeve 10 is not biased during sheet intervals or during a standby period. The detected voltage value is at the level 1. When the development sleeve 10 is biased with the process cartridge B full of toner during a printing operation, the detected voltage value becomes a level 2. A level 3 refers to a voltage at which the toner amount of the process cartridge B is small.

As in the first embodiment, a threshold is set up at a voltage level which is lower than a full amount value by a constant voltage. When the full amount value is calculated by averaging detected voltage values, the capacitance is detected in the form of voltage with a voltage applied to the development sleeve 10 as in the first embodiment. A plurality of voltage values a1–a6 are detected during a predetermined period of time. The CPU 509 sums the plurality of detected voltage values a1–a6 and then subjects the sum to an averaging operation.

In the second embodiment, each of the voltage values detected during the constant period of time T is compared with the threshold, and any detected voltage equal to or lower than the threshold is excluded from the summing operation carried out by the CPU 509. Specifically, the detected voltage value a2 from among the plurality of detected voltage values a1–a6 detected during the constant period of time T is at a level 1 which is lower than a set threshold. The detected voltage value a2 is thus removed before the summing process is carried out. With the removal process, the developer full amount value free from the influence of noise is obtained through the averaging operation. An error in the detection of the developer is thus prevented.

When the developer full amount setting value (corresponding to the developer full amount value with the developer container 14 full of the developer) is stored in accordance with the first embodiment of the present invention, whether or not to store the developer full amount value is determined based on the detected voltage values from the first electrode 51 and second electrode 52. The error in the detection of the developer amount due to noise is thus prevented.

In accordance with the second embodiment, as in the first embodiment, the two electrodes are employed. The threshold is set up for the voltage detected by the two electrodes corresponding to the developer amount value. If the detected voltage value drops below the threshold due to the influence of noise, that detected voltage value is removed in the calculation of the developer full amount value. The error in the detection of the developer amount due to noise is thus prevented.

Third Embodiment

The first and second embodiments are related to the detection method of the toner remaining amount with noise affecting the detected values through the electrodes (antenna) in the developer container 14. The toner remaining amount is detected when the process cartridge B is really new or at the initial phase of use of a new cartridge, in other words, when the developer container 14 is full of the developer.

In a third embodiment, the toner amount is detected with noise removed when the noise entering through antennas NPA and FPA arranged in the cartridge adversely affects the detected values.

An electrophotographic printer of the third embodiment of the present invention will now be discussed.

<Construction>

Figure 12:
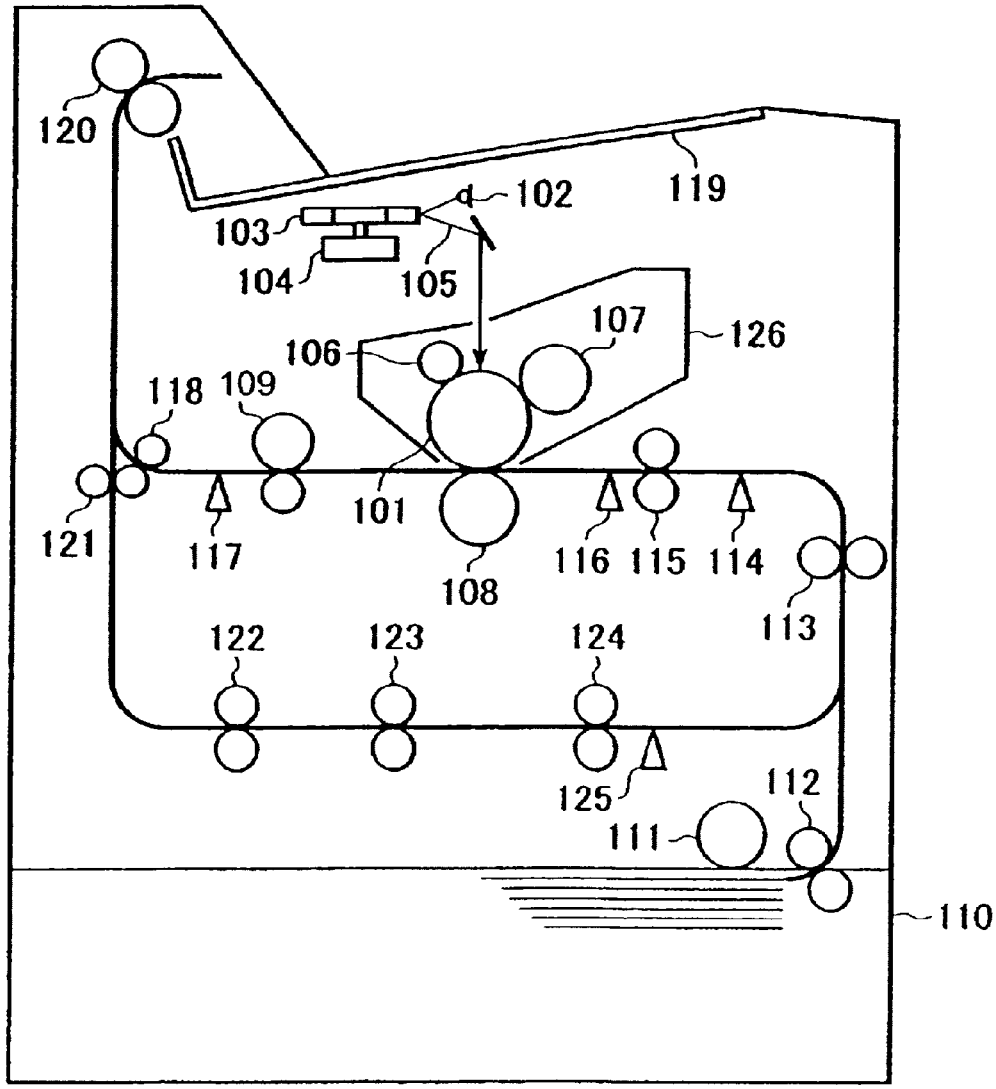
FIG. 12 is shows a printer of a third embodiment of the present invention.

FIG. 12 shows the construction of the printer of the third embodiment. There are shown a photoconductive drum 101 as an electrostatic charge bearing structure, semiconductor laser 102 as a light source, polygon mirror 103 rotated by a scanning motor 104, and laser beam 105 which is emitted from the semiconductor laser 102 and scans the photoconductive drum 101.

There are also shown a charging roller 106 for uniformly charging the photoconductive drum 101, and development unit 107 (development roller) for developing an electrostatic latent image into a developer image (hereinafter referred to as a "toner image"). Also shown in FIG. 12 are a transfer roller 108 for transferring the toner image formed on the development unit 107 to a predetermined recording sheet and a fixing unit 109 for fixing the toner image onto the recording sheet by fusing the toner image.

A sheet cassette feeder 110 has the function of identifying the sheet size of the recording sheets and holds the recording sheets. A feeder roller 111 feeds and conveys the sheets from the sheet cassette feeder 110. Conveyance roller pairs 112 and 113 convey the recording sheet.

FIG. 12 also shows a pre-feed sensor 114 for detecting the forward edge and backward edge of the supplied sheet, pre-transfer roller pair 115 for feeding the sheet to the photoconductive drum 101, and top sensor 116 which causes the supplying of the recording sheet to be synchronized with the writing (recording) of an image on the photoconductive drum 101 while measuring the length of the supplied sheet in the direction of sheet conveyance. Also shown are a discharge sensor 117 for detecting the presence or absence of the sheet subsequent to the fixing operation, discharge roller pair 118 for conveying the fixed sheet to a discharge tray 119, discharge sheet reversal roller pair 120 which rotates in a normal direction to discharge the recording sheet from the discharge roller pair 118 to the discharge tray 119 and rotates in a reverse direction to convey the recording sheet to a both-side printing conveyance section, both-side printing input roller pair 121 for guiding the recording sheet from the discharge sheet reversal roller pair 120 into the both-side printing conveyance section, both-side printing conveyance roller pairs 122–124, and refeed sensor 125 for detecting the conveyance state of the sheet in the both-side printing conveyance section.

A toner cartridge 126, which is detachably mountable, includes the photoconductive drum 101, charging roller 106 and development unit 107 in a unitary body. A cartridge door, which is opened to detach the toner cartridge 126, is not shown.

Figure 13:
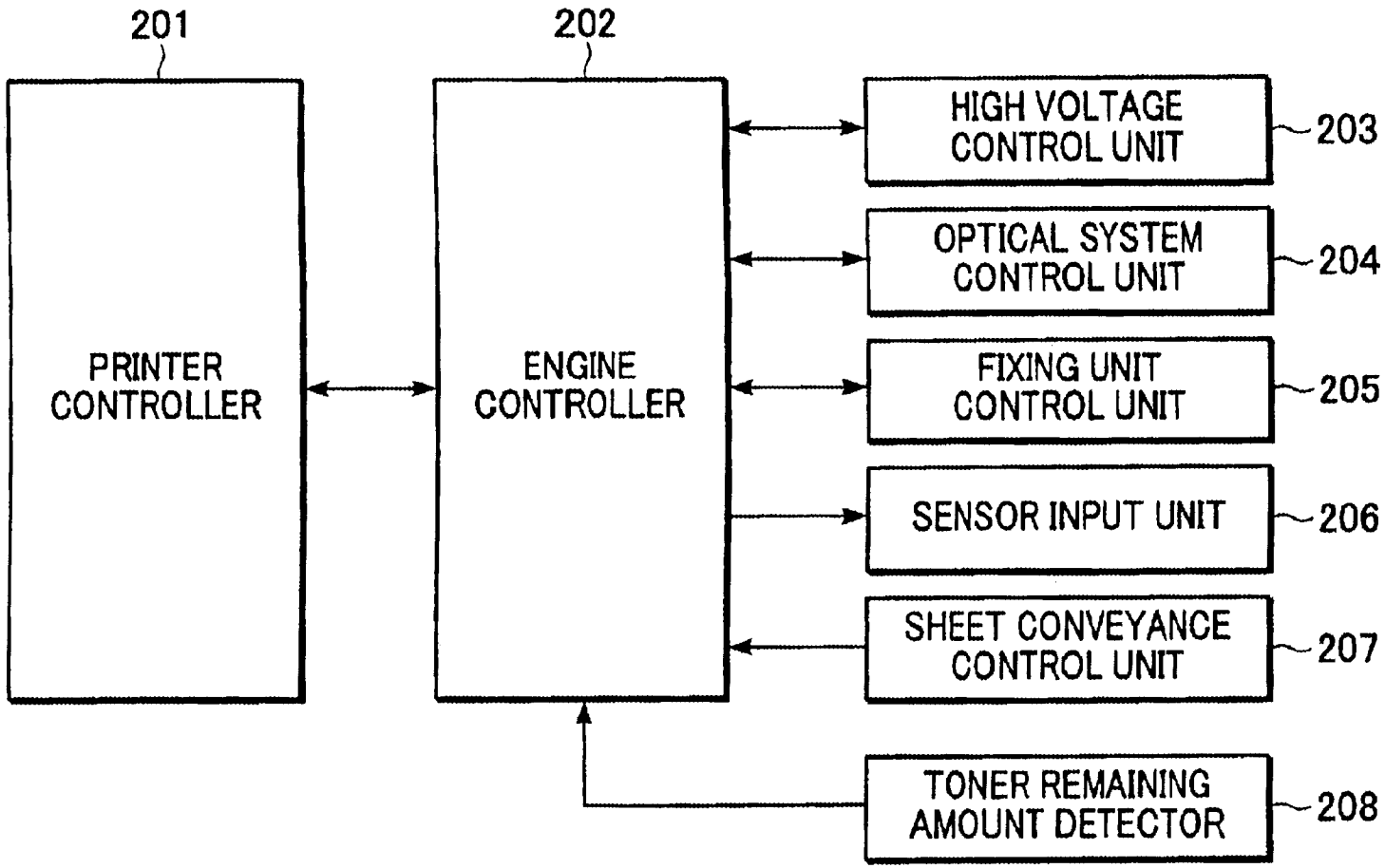
FIG. 13 is a block diagram showing a circuit arrangement of a control system in the printer of the third embodiment of the present invention.

FIG. 13 is a block diagram showing a circuit arrangement of a control system in the printer of the third embodiment of the present invention. As shown, a printer controller 201 develops image code data coming in from an external device such as a host computer (not shown) into bit data required for printing on the printer while reading and displaying printer internal information.

A printer engine controller 202 controls each block of a printer engine in response to instructions from the printer controller 201, while informing the printer controller 201 of printer internal information. A high voltage control unit 203 controls a high voltage output in each of charging, development, and transfer steps in response to an instruction from the printer engine controller 202. An optical system control unit 204 controls the scanning motor 104 for rotation and stopping rotation, and outputting of the laser beam in response to an instruction from the printer engine controller 202. A fixing device control unit 205 controls conduction of current to a fixing heater and stopping the conduction in response to an instruction from the printer engine controller 202.

A sensor input unit 206 informs the printer engine controller 202 of the presence or absence of the sheet in the pre-feed sensor 114, top sensor 116, and discharge sensor 117, and temperature detected by a thermistor (not shown) for outside air temperature detection. A sheet conveyance control unit 207 drives and stops motors and rollers for sheet conveyance in response to an instruction from the printer engine controller 202. Specifically, the sheet conveyance control unit 207 controls the driving and stopping of the feeder roller 111, conveyance roller pairs 112 and 113, pre-transfer roller pair 115, fixing roller 109, discharge roller pair 118, both-side printing input roller pair 121, and both-side printing conveyance rollers 122–124.

A toner remaining amount detector 208 including a detector circuit detects the remaining amount of toner. The construction of the detector circuit will be discussed later.

<Detection of the Toner Remaining Amount>

Figure 14:
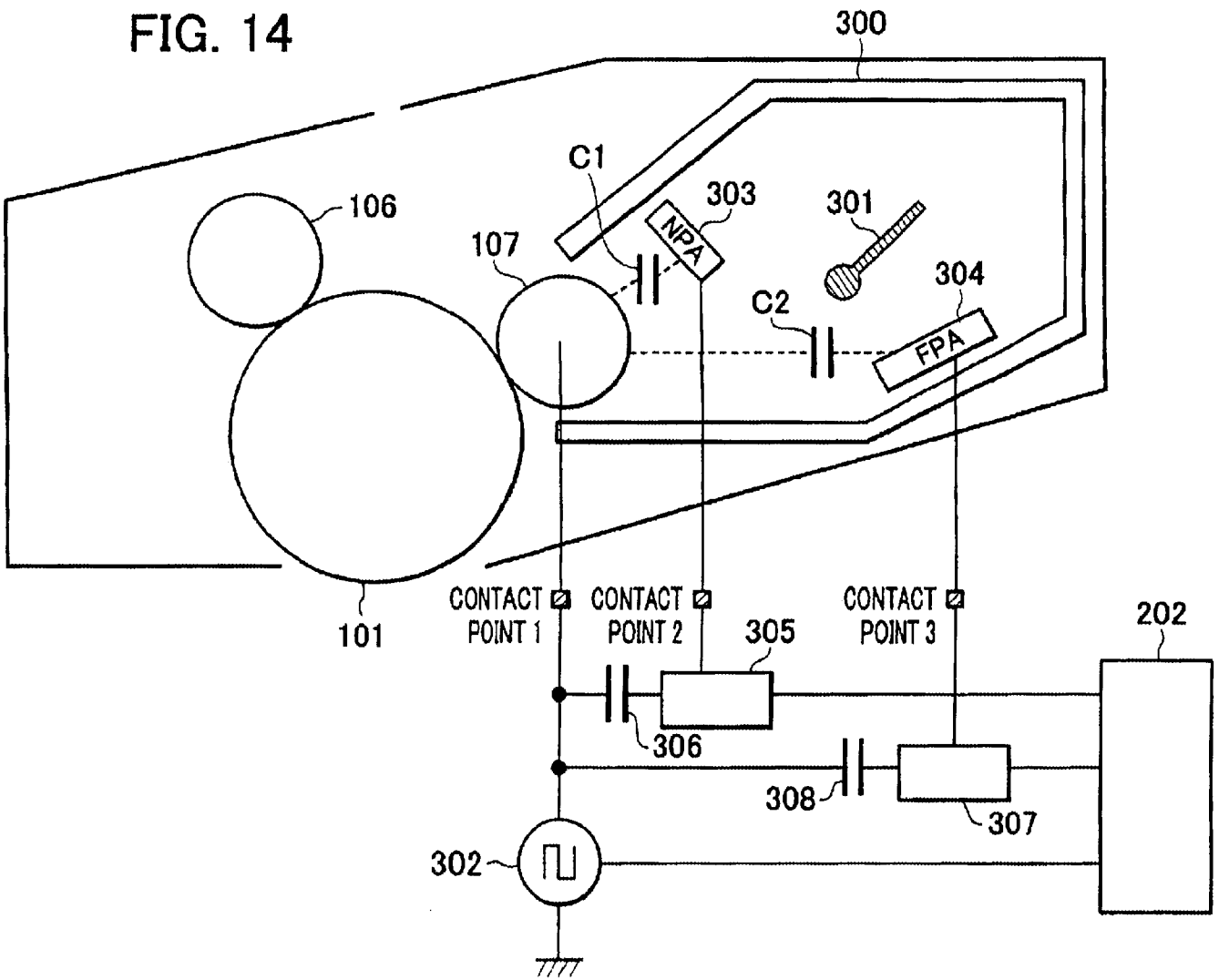
FIG. 14 shows an internal structure of the cartridge of the third embodiment and a toner remaining amount detector circuit thereof.

FIG. 14 diagrammatically shows a toner remaining amount detector circuit. As shown, a toner container 300 includes an agitator bar 301 which, rotated by a motor (not shown), agitates the toner in the toner container 300. The agitator bar 301 collects the toner in the vicinity of a developer bearing structure 107 in the toner container 300. A near plate antenna (hereinafter referred to as NPA) 303 is arranged close to the developer bearing structure 107 in the toner container 300. A far plate antenna (hereinafter referred to as FPA) 304 is arranged farther apart from the developer bearing structure 107 than the NPA 303.

The printer engine controller 202 applies a development bias to the developer bearing structure 107 through a development bias output circuit 302 and contact point 1. Voltages are induced in the NPA 303 and FPA 304, thereby creating a capacitance C1 between the developer bearing structure 107 and NPA 303 and a capacitance C2 between the developer bearing structure 107 and FPA 304. The development bias output circuit 302 is contained in the high voltage control unit 203 shown in FIG. 13.

The capacitance C1 is detected by a detector circuit 305. The detector circuit 305 compares the capacitance C1 with the capacitance of a reference capacitor 306, and notifies the printer engine controller 202 of a difference therebetween in an analog voltage form. The voltage detected by the detector circuit 305 corresponds to the capacitance C1.

The capacitance C2 between the FPA 304 and developer bearing structure 107 is detected by a detector circuit 307. The detector circuit 307 compares the capacitance C2 with the capacitance of a reference capacitor 308, and notifies the printer engine controller 202 of a difference therebetween. The voltage detected by the detector circuit 307 corresponds to the capacitance C2.

The detector circuit 305, reference capacitor 306, detector circuit 307, and reference capacitor 308 are contained in the toner remaining amount detector 208 shown in FIG. 13. The detector circuits 305 and 307 are identical in construction and operation to those discussed in connection with the first embodiment.

A low detected voltage means that a large amount of toner is present between the developer bearing structure 107 and the antenna. Conversely, a high detected voltage means that a small amount of toner is present between the developer bearing structure 107 and the antenna.

<Printing Operation>

The photoconductive drum 101 is uniformly charged by the charging roller 106. A laser beam 105 emitted from the semiconductor laser 102 forms an electrostatic latent image on the photoconductive drum 101. When the developer bearing structure 107 is supplied with a development bias, the developer (toner) on the developer bearing structure 107 adheres to the photoconductive drum 101 by means static charge, and the electrostatic latent image is developed into a toner image on the photoconductive drum 101.

<Voltage Change>

Figure 15:
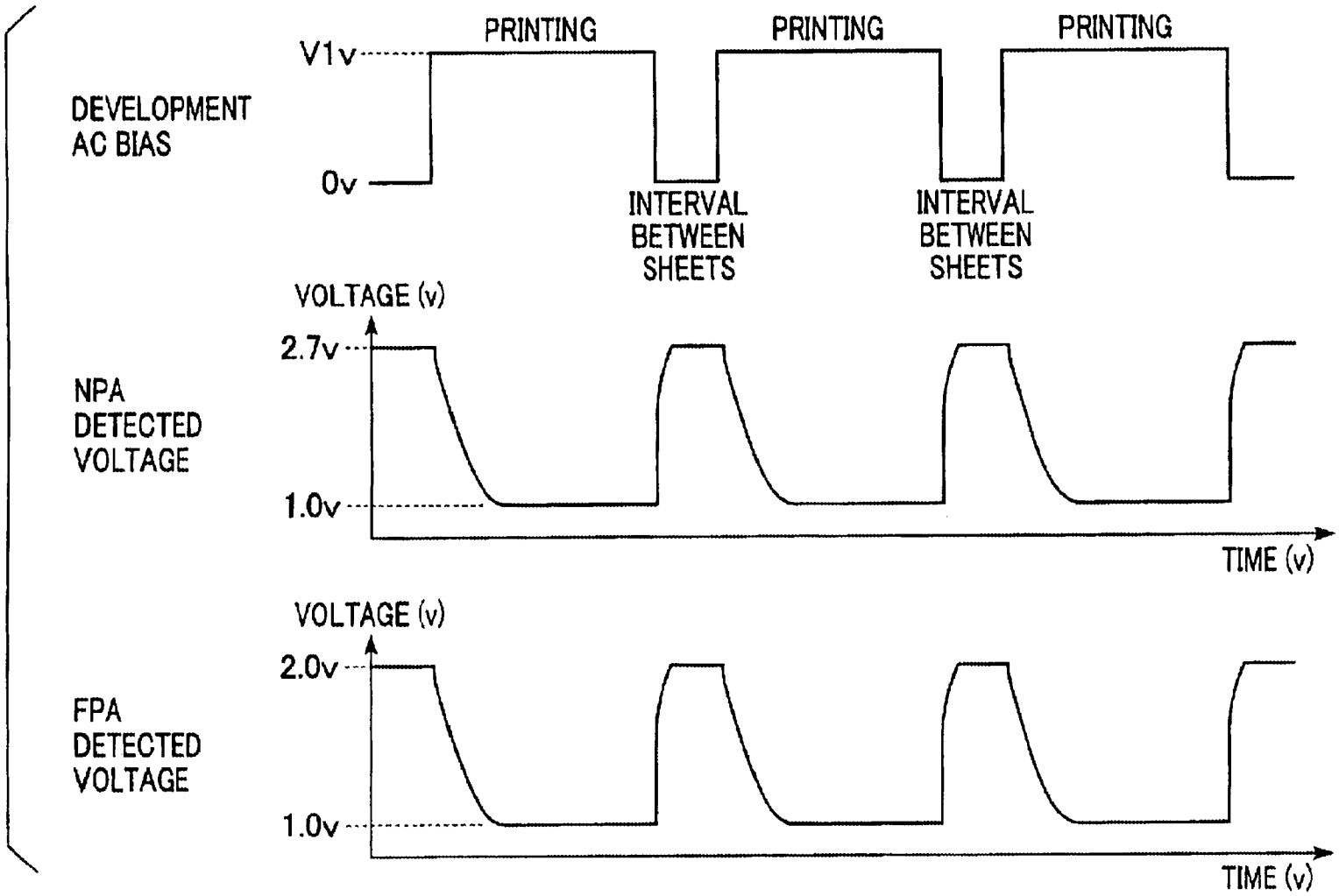
FIG. 15 is a waveform diagram of an NPA detected voltage, FPA detected voltage, and development AC bias with no noise superimposed on the voltages in accordance with third and fourth embodiments.

FIG. 15. shows an application timing of the development bias and change in the analog voltage input to the printer engine controller 202.

The development bias is applied to form the toner image on the photoconductive drum 101. During a continuous printing operation, the development bias is applied at the timing shown in the top portion of FIG. 15. With no external noise, the voltages at the NPA 303 and FPA 304 rise in response to the application of the development bias. The NPA detected voltage and FPA detected voltage are driven low during the printing operation and high during sheet intervals as shown in the middle and bottom portions of FIG. 15.

Figure 16:
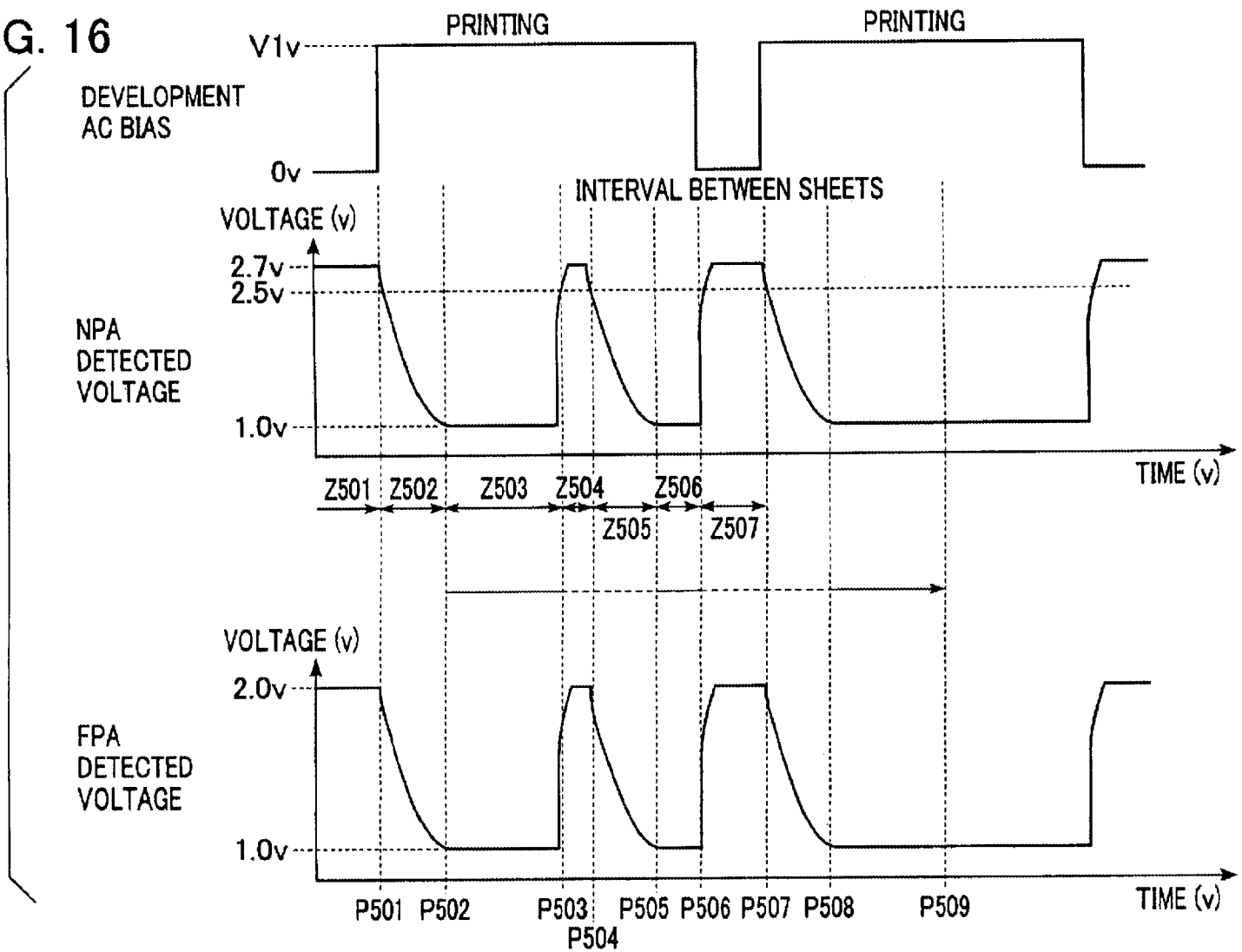
FIG. 16 is a waveform diagram of the NPA detected voltage, FPA detected voltage and development AC bias with noise superimposed on the voltages in accordance with the third embodiment.

However, if a foreign matter drops in the vicinity of the contact point 1 shown in FIG. 14 shorting momentarily the contact point 1 to ground, noise is caused on a detected analog voltage. Furthermore, external noise may be added to the detected voltage. FIG. 16 is a waveform diagram of the NPA detected voltage, FPA detected voltage and development AC bias with noise superimposed on the voltages. As shown, the detected voltage momentarily rises during the printing operation. There is a possibility that the amount of toner is determined to be small despite of the presence of a large remaining amount of toner.

<Toner Remaining Amount Detection Process>

Figure 17:
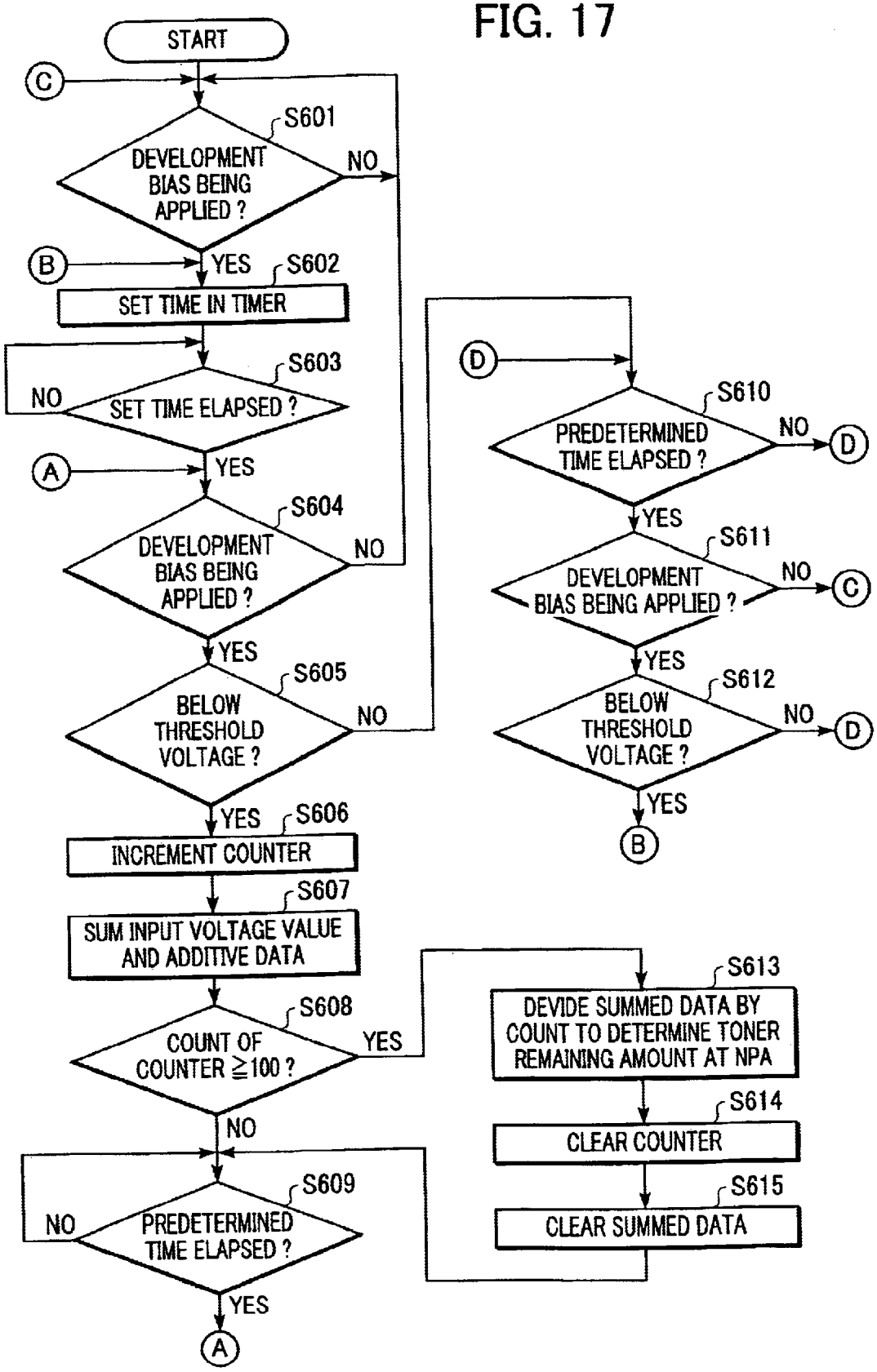
FIG. 17 is a flow diagram of a control method in accordance with the third embodiment of the present invention.

A toner remaining amount detection process described in a flow diagram shown in FIG. 17 is performed so that the toner remaining amount is not erratically detected when noise appears in the detected voltage as shown in FIG. 16. FIG. 17 is the flow diagram of the toner remaining amount detection process performed by the NPA 303.

In step S601, the printer controller 201 determines whether the development bias is currently being applied. During a period Z501 shown in FIG. 16, no development bias is applied, and the printer controller 201 waits on standby until the development bias is applied. When the development bias is applied, the algorithm proceeds to step S602.

A predetermined time is required between the application of the development bias and the output of a predetermined analog voltage. For this reason, the printer controller 201 sets the predetermined time (400 ms, for example) in step S602 so that the printer engine controller 202 does not sample the voltage within the period Z501.

The printer controller 201 determines in step S603 whether the set time has elapsed. If it is determined that the set time has not elapsed yet, the printer controller 201 waits on standby. If it is determined in step S603 that the set time has elapsed, the algorithm proceeds to step S604. The printer controller 201 determines whether the development bias is currently applied.

In step S605, the printer controller 201 checks the analog voltage output by the NPA detector circuit 305 to see if the analog voltage is equal to or below 2.5 V. This threshold voltage is used to determine whether the detected voltage is affected by noise, and is stored beforehand in a ROM (not shown) in the printer engine controller 202. Since the NPA detector circuit 305 outputs about a 1 V analog voltage during the Z503 period shown in FIG. 16, the algorithm proceeds to step S606.

A counter is incremented to count the number of detections in step S606. In step S607, digital data into which the analog voltage output from the NPA detector circuit 305 is analog-to-digital converted is summed. In step S608, the printer controller 201 determines whether the count incremented in step S606 exceeds a predetermined number (100, for example). If it is determined that the count is below 100, the printer controller 201 waits for a predetermined period of time (10 ms, for example) in step S609, and then starts over again with step S604. This cycle is repeated within the period Z503 (period of timing from P502 to P503) shown in FIG. 16 until the count of the counter exceeds 100. In step S607, the printer controller 201 sums data by adding analog-to-digital converted data to summed data. If it is determined in step S605 that the NPA detector circuit 305 outputs an analog voltage above a predetermined threshold 2.5 V during a period Z504 (period of timing from P503 to P504) shown in FIG. 16, the algorithm proceeds to step S610. As in step S609, the printer controller 201 waits for a predetermined time in step S610. The printer controller 201 verifies in step S611 that the development bias is currently applied, and checks in step S612 the analog voltage output from the NPA detector circuit 305 again. The printer controller 201 repeats this process until the analog voltage becomes equal to or lower than 2.5 V.

Specifically, step S610 through step S612 are repeated until a voltage equal to or below the threshold 2.5 V is detected during the period Z504 shown in FIG. 16. If the analog voltage output from the NPA detector circuit 305 equal to or below 2.5 V is detected in step S612, the data of the analog voltage output from the NPA detector circuit 305 during the period Z504 as during a period Z502 (period of timing from P501 to P502) is removed. The algorithm starts over with step S602 again. As during the period Z503, steps S604–S609 are repeated during a period Z506 (period of timing from P505 To P506) shown in FIG. 16. If it is determined in step S611 that no development bias is currently applied, the image forming apparatus is considered to have completed the printing of a first page within a period Z507 (period of timing from P506 to P507) shown in FIG. 16, and to have shifted to a sheet interval prior to the printing of a second page. The algorithm then loops to step S601. At the startup of the printing of the second page, the printer controller 201 starts with step S601 and then repeats steps S604–S609.

P509 is a timing at which the count reaches 100 in step S608. If the count exceeds 100, the algorithm proceeds from step S608 to step S613. The summed data is averaged as the toner remaining amount between the developer bearing structure and the NPA 303. In step S614, the counter is cleared. The summed data is cleared in step S615. The process then starts over with step S609.

When the analog data output from the NPA detector circuit 305 rises above the threshold in the third embodiment, the corresponding signal is determined as noise. The data output from the NPA detector circuit 305 is not summed within a predetermined period of time from the moment of the detection of noise. Specifically, the toner remaining amount is not detected throughout periods Z502, Z504, Z505 (period of timing from P505 to P506), and Z507 shown in FIG. 16, and the toner amount is detected during the periods Z503 and Z506. Unlike the conventional art in which the toner amount is detected during the periods Z504 and Z505, the toner remaining amount is precisely detected in the present invention.

In the above discussion of the third embodiment, the NPA 303 only has been discussed. The FPA 304 may also be equally used. The presence of noise is determined based on the output of the NPA 303, and the data of the NPA 303 is then not sampled. The data of the FPA 304 may also be excluded from the sampling. Conversely, the presence of noise is determined based on the output of the FPA 304, and the data of the FPA 304 is then not sampled. The data of the NPA 303 may also be excluded from the sampling.

If the detected voltage rises above the threshold, the data summed until then may be cleared, and data summing may resume after the detected voltage drops below the threshold. If a sample period for an averaging process ends during the generation of noise (while the detected voltage is below the threshold), care must be exercised in the data summing.

Fourth Embodiment

If the analog voltage data output from the NPA detector circuit 305 is determined to be above the threshold, that data is considered noise in accordance with the third embodiment. Within the predetermined period of time from then, the output data from the NPA detector circuit 305 is not included in the summing operation. A precise toner remaining amount is thus detected.

In accordance with a fourth embodiment, if the analog voltage data output from the NPA detector circuit 305 is determined to be below a threshold, that data is considered noise. Data prior to the noise determination is discarded, and a precise toner remaining amount is detected.

Since it takes time for the detected voltage to fall to the threshold because of a time constant of the detector circuit, the reliability of the detected voltage obtained before falling down to the threshold is low. Unlike the third embodiment, the data before falling down to the threshold must be discarded to detect a precise toner remaining amount.

As specifically shown in FIG. 18, the duration required for the detected voltage to fall below 0.5 V within periods Z703 and Z704 is longer than the duration required for the detected voltage to rise above 2.5 V within the periods Z503 and Z504 in the third embodiment. The difference of the fourth embodiment from the third embodiment is that the data, which has been summed prior to the detection of noise, is removed.

The rest of the construction and operation of the fourth embodiment remain identical to those of the third embodiment. In the fourth embodiment, like elements are designated with like reference numerals, and the discussion thereof is omitted here.

Figure 18:
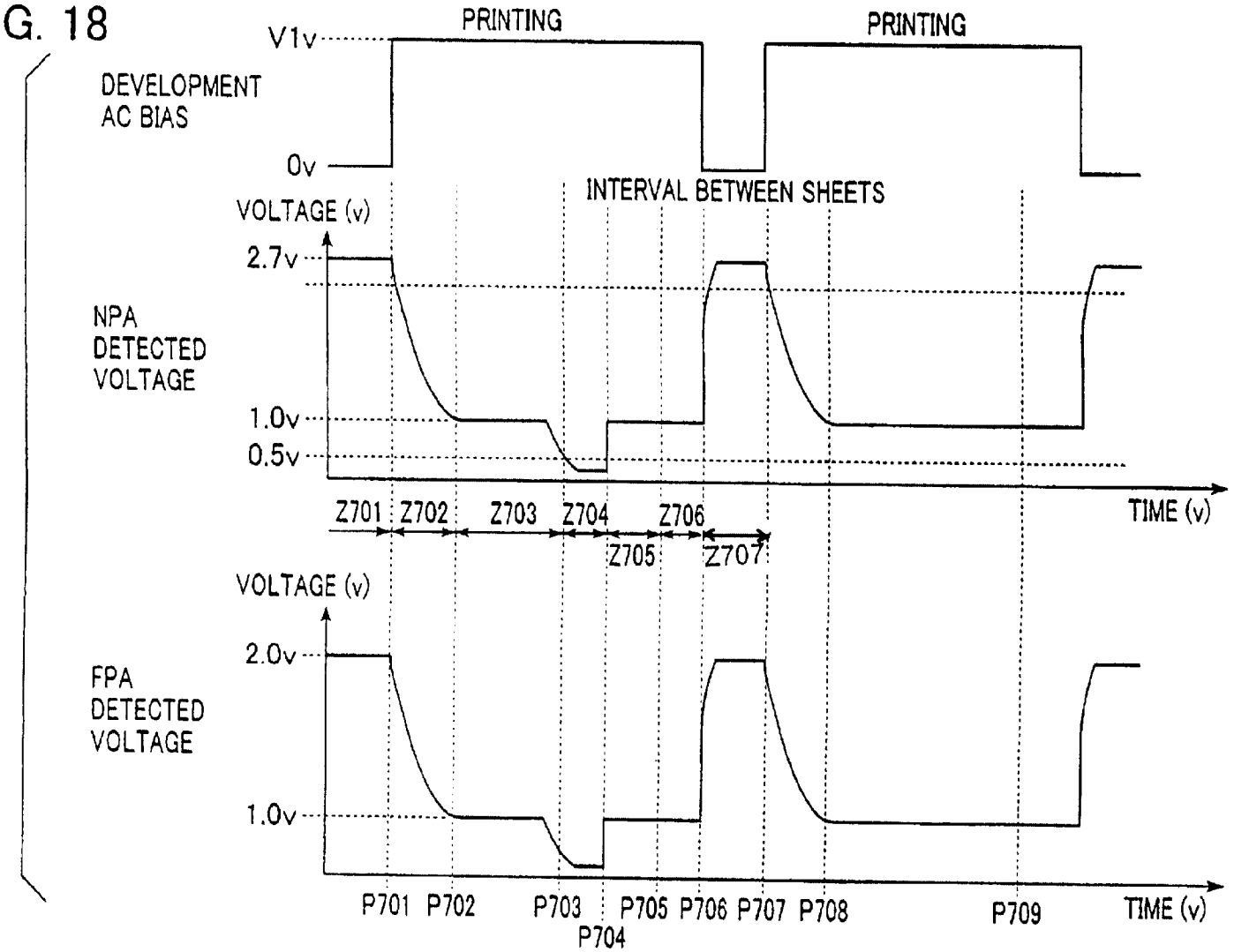
FIG. 18 is a waveform diagram of the NPA detected voltage, FPA detected voltage and development AC bias with noise superimposed on the voltages in accordance with the fourth embodiment.

FIG. 18 is a waveform diagram of the NPA detected voltage, FPA detected voltage and development AC bias with noise superimposed on the voltages in accordance with the fourth embodiment. As shown, the detected voltage drops during a printing operation.

Figure 19:
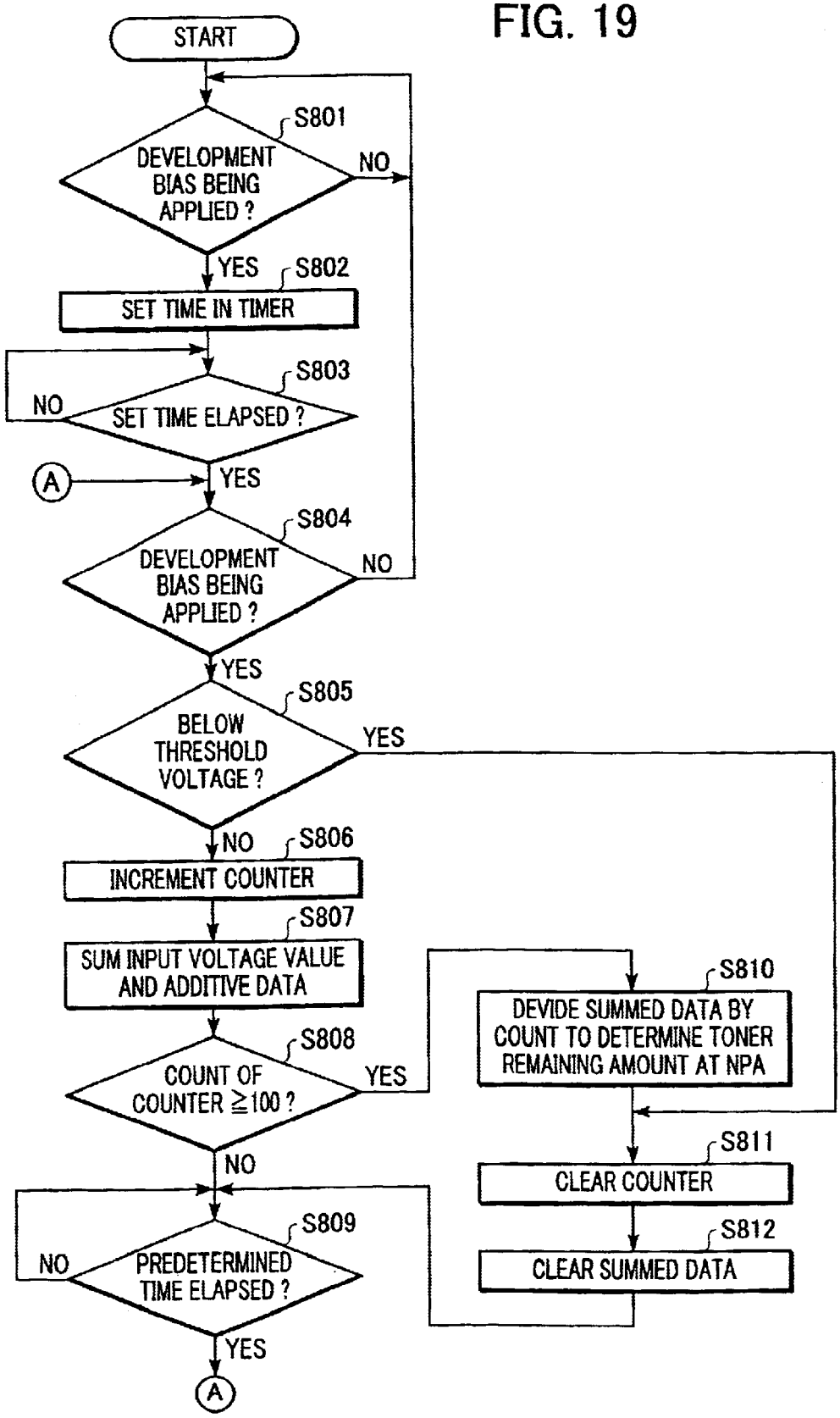
FIG. 19 is a flow diagram showing a control method in accordance with the fourth embodiment of the present invention.

In the fourth embodiment, a toner remaining amount detection process described in a flow diagram shown in FIG. 19 is performed so that the toner remaining amount is not erratically detected when noise appears in the detected voltage as shown in FIG. 18. FIG. 19 is the flow diagram of the toner remaining amount detection process performed by the NPA 303.

In step S801, the printer controller 201 determines whether the development bias is currently being applied. During a period Z701, no development bias is applied, and the printer controller 201 repeats S801 (waits on standby) until the development bias is applied. When the development bias is applied at P702, the algorithm proceeds to step S802. In step S802, a time constant occurs between the application of the development bias and the output of a predetermined analog voltage by the NPA 303, and then the printer engine controller 202 detects the voltage within the period Z702 (period of timing from P701 to P702). For this reason, the printer controller 201 sets the predetermined time (400 ms, for example) in step S802 so that the printer engine controller 202 does not sample the voltage.

The printer controller 201 determines in step S803 whether the time set in step S802 has elapsed. If it is determined that the set time has not elapsed yet, the printer controller 201 waits on standby. When it is determined in step S303 that the set time has elapsed, the algorithm proceeds to step S804. The printer controller 201 determines whether the development bias is currently applied. In step S805, the printer controller 201 checks the analog voltage output by the NPA detector circuit 305 to see if the analog voltage is equal to or below 0.5 V. As in the third embodiment, this threshold voltage is used to determine whether the detected voltage is affected by noise, and is stored beforehand in a ROM (not shown) in the printer engine controller 202.

Since the NPA detector circuit 305 outputs an about 1 V analog voltage during the Z703 period shown in FIG. 18, the algorithm proceeds to step S806. A counter is incremented to count the number of detections in step S806. In step S807, digital data into which the analog voltage output from the NPA detector circuit 305 is analog-to-digital converted is summed. In step S808, the printer controller 201 determines whether the count incremented in step S806 exceeds a predetermined number (100, for example). If it is determined that the count is below 100, the printer controller 201 waits for a predetermined period of time (10 ms, for example) in step S809, and then starts over again with step S804. This cycle is repeated within the period Z703 shown in FIG. 18 until the count of the counter exceeds 100. In step S807, the printer controller 201 sums data by adding analog-to-digital converted data to summed data. If it is determined in step S805 that the NPA detector circuit 305 outputs an analog voltage below the predetermined threshold 0.5 V during at timing P703, the algorithm proceeds to step S811. The detected voltage is determined to be noise. In step S811, the count of the counter incremented in step S806 is cleared. The data summed in step S806 is cleared in step S812. The process then starts over with step S809 to start sampling the analog data output from the NPA detector circuit 305. The above process is repeated until the analog voltage output from the NPA detector circuit 305 at the timing P704 shown in FIG. 18 becomes higher that 0.5 V. Z705 is a predetermined period from the timing P704, which the analog voltage becomes higher than 0.5 V, and the detected data is not added during this period.

As during the period Z703, steps S804–S809 are repeated during a period Z706 (period of timing from P705 to P706) shown in FIG. 18. The period Z707 (period of timing from P706 to P707) shown in FIG. 18 is a sheet interval between the completion of the printing of a first page and the beginning of the printing of a second page, and no development bias is applied throughout. The printer controller 201 waits on standby in step S801. To begin the printing of the second page, the printer controller 201 starts over with step S802 to repeat steps S804–S809. Here, the same operation at the timing P702 is performed at P708.

P709 is a timing at which the count reaches 100 in step S808. If the count exceeds 100, the algorithm proceeds to step S810. The summed data is averaged as the toner remaining amount between the developer bearing structure and the NPA 303. In step S811, the counter is cleared. The summed data is cleared in step S812. The process then starts over with step S809.

When the analog data output from the NPA detector circuit 305 below the threshold is detected, that data is considered noise in the fourth embodiment. All data sampled until then is deleted. Data sampling starts over again. A precise toner remaining amount is detected.

In the above discussion of the fourth embodiment, the NPA 303 only has been discussed. The FPA 304 may also be equally used. The presence of noise is determined based on the output of the NPA 303, and the data of the NPA 303 is then deleted. The data of the FPA 304 may also be deleted. Conversely, the presence of noise is determined based on the output of the FPA 304, and the data of the FPA 304 is then deleted. The data of the NPA 303 may also be deleted.

When the detected voltage is found to suffer from noise, the data is deleted, and data sampling starts over again. If data is found to contain noise, the toner amount may be determined without averaging data when 100 pieces of data are acquired.

In accordance with the third and fourth embodiments, the voltage detected by one of the detector circuits 305 and 307 is used as a measurement corresponding to the toner remaining amount. If the detected voltage falls outside the predetermined range, the detected voltage is determined to be noise. The present invention is not limited to this method. Another parameter such as the capacitances C1 and C2 may be used as long as the parameter corresponds to the toner remaining amount. As in the third and fourth embodiments, if the data of the parameter falls outside the predetermined range, that data is excluded from the determination process of the toner remaining amount.

The toner remaining amount is calculated at the moment 100 pieces of detected data as a result of increment are obtained in the third embodiment. The present invention is not limited to this method. Another number is acceptable as the maximum count. For example, the summed data may be averaged each time the agitator bar 301 has been rotated by N turns. Here, N is an integer equal to or larger than 1.

The third embodiment and fourth embodiments may be combined. In such a case, if YES in step S605 in FIG. 17, the algorithm proceeds to step S805 in FIG. 19. If NO in step S805 in FIG. 19, the algorithm proceeds to step S614 in FIG. 17.

Even if the detected voltage is influenced by noise in accordance with the above-referenced embodiments when the developer remaining amount in the developer container is detected, the measurements subject to noise are excluded from the determination process of the developer remaining amount. An image forming apparatus which reliably detects the amount of toner in a manner free from an error is provided, and a method for controlling the image forming apparatus is also provided.

The preferred embodiments of the present invention have been discussed. The present invention may be applied to a system composed of a plurality of apparatuses, or may be applied to a single standalone apparatus.

A computer program performing the function of the above-referenced embodiments is supplied to a system or apparatus directly or indirectly from a remote location, and a computer within the system or apparatus reads and executes program codes of the computer program. Such an arrangement falls within the scope of the present invention. If the system or apparatus has the function of the program, the form is not limited to the computer program.

Program codes themselves installed in the computer which carries out the function of the above-referenced embodiments embody the present invention. The computer program for carrying out the function of the above-referenced embodiments also falls within the scope of the present invention.

The software program is not limited to a particular form. The software program may be an object code, program carried out using an interpreter, script data fed to operating system (OS), etc.

Storage media for feeding the program code include a floppy disk (Registered Trademark), hard disk, optical disk, magneto-optical disk, CD-ROM (Compact Disk-ROM), CD-R (Recordable CD), CD-RW (Rewritable CD), magnetic tape, non-volatile memory card, ROM (Read-Only Memory), DVD (Digital Versatile Disk such DVD-ROM, DVD-R).

The software program may be supplied in the following ways. The user accesses a home page of the Internet on the user's own computer using a browser, and downloads a computer program or a compressed file with an auto-decompressing function of the present invention from the home page and stores the computer program or file onto a hard disk. Furthermore, the program codes of the computer program of the present invention may be divided into a plurality of files, and the plurality of files may be downloaded from different home pages.

The computer program of the present invention may be encrypted and stored in a storage medium such as a CD-ROM. The CD-ROM is delivered to the users. Any user who satisfies predetermined conditions is allowed to download key information to decrypt the encrypted computer program from a home page through the Internet. The encrypted program is decrypted using the key information, and the decrypted program is installed in the computer.

The function of the above-referenced embodiments is performed when the computer executes the read program. In response to an instruction of the program, the OS running on the computer performs the process in part or in whole. The function of the above-referenced embodiments is thus performed as a result.

The program read from the storage medium is written on a memory in a feature expansion board inserted into the computer or a feature expansion unit connected to the computer. A CPU mounted on the feature expansion board or the feature expansion unit performs partly or entirely the actual process in response to the instruction from the program. The function of the above-referenced embodiments is thus performed as a result.

While the present invention has been described with reference to what are presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus having a developer container containing a developer, a developer supply member for supplying the developer from the developer container to an image bearing member, and first and second detector members for detecting the amount of the developer, the image forming apparatus comprising:

a storage unit for storing information relating to the developer;

a first detector for detecting a value corresponding to a capacitance between the first detector member and the developer supply member;

a second detector for detecting a value corresponding to a capacitance between the second detector member and the developer supply member; and a processor for storing the values detected by the first and second detectors, respectively, wherein the processor avoids storing the detected values if the detected values are in a predetermined state.

2. An image forming apparatus according to claim 1, wherein the predetermined state is that one of the value detected by the first detector and the value detected by the second detector is equal to or below a predetermined threshold.

3. An image forming apparatus according to claim 1, wherein the detected value is detected when the developer in the container is in the full condition.

4. An image forming apparatus according to claim 1, wherein each of the first and second detector members comprises an electrode.

5. An image forming apparatus according to claim 1, wherein a cartridge, into which the developer container and the storage unit are integrated, is detachably mounted on the image forming apparatus, and wherein the processor stores the detected value in the storage unit if the cartridge is a new one.

6. An image forming apparatus having a developer container containing a developer, a developer supply member for supplying the developer from the developer container to an image bearing member, and first and second detector members for detecting the amount of the developer, the image forming apparatus comprising:

a storage unit for storing information relating to the developer;

a first detector for detecting a value corresponding to a capacitance between the first detector member and the developer supply member;

a second detector for detecting a value corresponding to a capacitance between the second detector member and the developer supply member; and a calculator for calculating the amount of the developer in the developer container based on a plurality of values which are detected by one of the first and second detectors during a predetermined period of time, wherein the calculator compares the plurality of values detected during the predetermined period of time with a predetermined threshold, and avoids using in the calculation of the amount of the developer any one of the plurality of values that is determined to be equal to or below the threshold.

7. An image forming apparatus according to claim 6, wherein a cartridge, into which the developer container and the developer supply member are integrated, is detachably mounted on the image forming apparatus, and wherein the calculator calculates the amount of the developer using the plurality of detected values if the cartridge is a new one.

8. An image forming apparatus according to claim 6, wherein each of the first and second detector members comprises an electrode.

9. An image forming apparatus according to claim 6, wherein the plurality of values is detected when the developer in the container is in the full condition.

10. A method for controlling an image forming apparatus having a developer container containing a developer, a developer supply member for supplying the developer from the developer container to an image bearing member, first and second detector members for detecting the amount of the developer, and a storage unit for storing information relating to the developer, the method comprising:

a first step of detecting a value corresponding to a capacitance between the first detector member and the developer supply member and a value corresponding to a capacitance between the second detector member and the developer supply member;

a second step of storing the values, detected in the first step, in the storage unit; and a third step of avoiding storing the detected values if the values detected in the first step are at a predetermined state.

11. A method according to claim 10, further comprising a fourth step of determining whether each of the detected values is equal to or smaller than a threshold.

12. A method for controlling an image forming apparatus having a developer container containing a developer, a developer supply member for supplying the developer from the developer container to an image bearing member, first and second detector members for detecting the amount of the developer, and a storage unit for storing information relating to the developer, the method comprising:

a first step of detecting a value corresponding to a capacitance between the first detector member and the developer supply member and a value corresponding to a capacitance between the second detector member and the developer supply member;

a second step of calculating the amount of the developer within the developer container based on a plurality of values which are detected by one of the first and second detector members during a predetermined period of time;

a third step of comparing each of the plurality of values detected during the predetermined period of time with a predetermined threshold; and a fourth step of avoiding using, in the calculation in the second step, any one of the plurality of detected values which is determined to be equal to or smaller than the predetermined threshold.

13. A method according to claim 12, wherein a cartridge, into which the developer container and the developer supply member are integrated, is detachably mounted on the image forming apparatus, and wherein the second step comprises calculating the amount of developer using the plurality of detected values if the cartridge is a new one.

* * * * *